US009624919B2

(12) United States Patent
Yamamoto et al.

(10) Patent No.: US 9,624,919 B2
(45) Date of Patent: Apr. 18, 2017

(54) VARIABLE DISPLACEMENT SWASH PLATE TYPE COMPRESSOR

(71) Applicant: KABUSHIKI KAISHA TOYOTA JIDOSHOKKI, Kariya-shi, Aichi-ken (JP)

(72) Inventors: Shinya Yamamoto, Kariya (JP); Takahiro Suzuki, Kariya (JP); Kazunari Honda, Kariya (JP); Kei Nishii, Kariya (JP); Yusuke Yamazaki, Kariya (JP)

(73) Assignee: KABUSHIKI KAISHA TOYOTA JIDOSHOKKI, Kariya-shi, Aichi-ken (JP)

( * ) Notice: Subject to any disclaimer, the term of this patent is extended or adjusted under 35 U.S.C. 154(b) by 70 days.

(21) Appl. No.: 14/779,588

(22) PCT Filed: Mar. 28, 2014

(86) PCT No.: PCT/JP2014/059080
§ 371 (c)(1),
(2) Date: Sep. 24, 2015

(87) PCT Pub. No.: WO2014/157604
PCT Pub. Date: Oct. 2, 2014

(65) Prior Publication Data

US 2016/0047366 A1 Feb. 18, 2016

(30) Foreign Application Priority Data

Mar. 29, 2013 (JP) ..... 2013-073818

(51) Int. Cl.
*F04B 1/29* (2006.01)
*F04B 27/08* (2006.01)
(Continued)

(52) U.S. Cl.
CPC ..... *F04B 27/086* (2013.01); *F04B 27/1045* (2013.01); *F04B 27/1054* (2013.01);
(Continued)

(58) Field of Classification Search
CPC .. F04B 27/18; F04B 27/1804; F04B 27/1809; F04B 27/1813
See application file for complete search history.

(56) References Cited

U.S. PATENT DOCUMENTS 4,108,577 A * 8/1978 Brucken ..... F04B 27/18 417/222.1
5,259,736 A * 11/1993 Terauchi ..... F01B 3/106 417/222.1
(Continued)

FOREIGN PATENT DOCUMENTS

JP 2-19665 A 1/1990
JP 3-11168 A 1/1991
(Continued)

OTHER PUBLICATIONS

International Preliminary Report on Patentability dated Sep. 29, 2015 issued on counterpart application No. PCT/JP2014/059080.

*Primary Examiner* — Michael Leslie
(74) *Attorney, Agent, or Firm* — Sughrue Mion, PLLC

(57) ABSTRACT

A fourth pin that slides on a rotary shaft is provided to a swash plate. A guiding surface for guiding the fourth pin is provided to the rotary shaft. The fourth pin is guided by the guiding surface, the swash plate is supported by the rotary shaft via the fourth pin, and a force having a component in a direction orthogonal to the direction of movement of a movable body acting on the swash plate is thereby reduced. Accordingly, there is a reduction in the force, which has a component in a direction orthogonal to the direction of movement of the movable body, acting on a coupling section of the movable body via a third pin from the swash plate. As
(Continued)

a result, when the inclination of the swash plate is changed, unwanted tilting of the movable body relative to the direction of movement is suppressed.

8 Claims, 11 Drawing Sheets

(51) Int. Cl.
*F04B 27/10* (2006.01)
*F04B 27/18* (2006.01)

(52) U.S. Cl.
CPC ..... *F04B 27/1081* (2013.01); *F04B 27/18* (2013.01); *F04B 27/1804* (2013.01); *F04B 2027/1813* (2013.01)

(56) References Cited

U.S. PATENT DOCUMENTS 9,309,874 B2 * 4/2016 Yamamoto ..... F04B 27/1063
2015/0132156 A1 * 5/2015 Honda ..... F04B 27/18
417/269

FOREIGN PATENT DOCUMENTS

JP 5-172052 A 7/1993
JP 6-58108 B2 8/1994

* cited by examiner

VARIABLE DISPLACEMENT SWASH PLATE TYPE COMPRESSOR

CROSS REFERENCE TO RELATED APPLICATIONS

This application is a National Stage of International Application No. PCT/JP2014/059080filed Mar. 28, 2014, claiming priority based on Japanese Patent Application No. 2013-073818filed Mar. 29, 2013, the contents of all of which are incorporated herein by reference in their entirety.

TECHNICAL FIELD

The present invention relates to a variable displacement swash plate type compressor.

BACKGROUND ART

Such a variable displacement swash plate type compressor (hereinafter, simply referred to as "compressor") is disclosed in Patent Document 1. As shown in FIGS. 10 and 11, a compressor 100 disclosed in Patent Document 1 includes a housing 101, which has a cylinder block 102, a front housing member 104, and a rear housing member 105. The front housing member 104 closes the front end of the cylinder block 102 via a valve plate 103*a*, and the rear housing member 105 closes the rear end of the cylinder block 102 via a valve plate 103*b*.

A through hole 102*h* is located at the center of the cylinder block 102. The through hole 102*h* receives a rotary shaft 106, which extends through the front housing member 104. The cylinder block 102 has cylinder bores 107 arranged about the rotary shaft 106. Each cylinder bore 107 houses a double-headed piston 108. The cylinder block 102 further has a crank chamber 102*a*. The crank chamber 102*a* accommodates a tiltable swash plate 109, which rotates when receiving drive force from the rotary shaft 106. Each double-headed piston 108 is engaged with the swash plate 109 via shoes 110. The front housing member 104 and the rear housing member 105 have suction chambers 104*a*, 105*a* and discharge chambers 104*b*, 105*b*, which communicate with the cylinder bores 107.

An actuator 111 is arranged at the rear end of the through hole 102*h* of the cylinder block 102. The actuator 111 accommodates the rear end of the rotary shaft 106. The interior of the actuator 111 is slidable along the rear end of the rotary shaft 106. The periphery of the actuator 111 is slidable along the through hole 102*h*. A pressing spring 112 is located between the actuator 111 and the valve plate 103*b*. The pressing spring 112 urges the actuator 111 toward the front end of the rotary shaft 106. The urging force of the pressing spring 112 is determined by the balance with the pressure in the crank chamber 102*a*.

A part of the through hole 102*h* that is rearward of the actuator 111 communicates with a pressure regulating chamber 117, which is provided in the rear housing member 105, via a through hole in the valve plate 103*b*. The pressure regulating chamber 117 is connected to the discharge chamber 105*b* via a pressure regulating circuit 118. A pressure control valve 119 is arranged in the pressure regulating circuit 118. The amount of movement of the actuator 111 is adjusted by the pressure in the pressure regulating chamber 117.

A first coupling body 114 is arranged in front of the actuator 111 with a thrust bearing 113 in between. The rotary shaft 106 extends through the first coupling body 114. The interior of the first coupling body 114 is slidable along the rotary shaft 106. The first coupling body 114 is designed to slide along the axis of the rotary shaft 106 when the actuator 111 slides. The first coupling body 114 has a first arm 114*a*, which extends outward from the periphery. The first arm 114*a* has a first pin guiding groove 114*h*, which is provided by cutting out a part diagonally with respect to the axis of the rotary shaft 106.

A second coupling body 115 is arranged in front of the swash plate 109. The second coupling body 115 is fixed to the rotary shaft 106 to rotate integrally with the rotary shaft 106. The second coupling body 115 has a second arm 115*a*, which extends outward from the periphery and is located at a substantially symmetrical position with respect to the first arm 114*a*. The second arm 115*a* has a second pin guiding groove 115*h*, which extends through the second arm 115*a* in a diagonal direction with respect to the axis of the rotary shaft 106.

Two first supporting lobes 109*a*, which extend toward the first arm 114*a*, are provided on a surface of the swash plate 109 that faces the first coupling body 114. The first arm 114*a* is located between the two first supporting lobes 109*a*. The first supporting lobes 109*a* and the first arm 114*a* are pivotally coupled to each other by a first coupling pin 114*p*, which extends through the first pin guiding groove 114*h*.

Two second supporting lobes 109*b*, which extend toward the second arm 115*a*, are provided on a surface of the swash plate 109 that faces the second coupling body 115. The second arm 115*a* is located between the second supporting lobes 109*b*. The second supporting lobes 109*b* and the second arm 115*a* are pivotally coupled to each other by a second coupling pin 115*p*, which extends through the second pin guiding groove 115*h*.

To decrease the displacement of the compressor 100, the pressure in the pressure regulating chamber 117 is lowered by closing the pressure control valve 119. This causes the pressure in the crank chamber 102*a* to be greater than the pressure in the pressure regulating chamber 117 and the urging force of the pressing spring 112. Accordingly, the actuator 111 is moved toward the valve plate 103*b* as shown in FIG. 10. At this time, the first coupling body 114 is pushed toward the actuator 111 by the pressure in the crank chamber 102*a*. The movement of the first coupling body 114 causes the first coupling pin 114*p* to be guided by the first pin guiding groove 114*h*, so that the first supporting lobes 109*a* rotate counterclockwise. As the first supporting lobes 109*a* rotate, the second supporting lobes 109*b* rotate counterclockwise, so that the second coupling pin 115*p* is guided by the second pin guiding groove 115*h*. This reduces the inclination angle of the swash plate 109 and thus reduces the stroke of the double-headed pistons 108. Accordingly, the displacement is decreased.

In contrast, to increase the displacement of the compressor 100, the pressure control valve 119 is opened to introduce high-pressure gas (control gas) from the discharge chamber 105*b* to the pressure regulating chamber 117 via the pressure regulating circuit 118, thereby increasing the pressure in the pressure regulating chamber 117. This causes the pressure in the pressure regulating chamber 117 and the urging force of the pressing spring 112 to be greater than the pressure in the crank chamber 102*a*. Accordingly, the actuator 111 is moved toward the swash plate 109 as shown in FIG. 11. At this time, the first coupling body 114 is pushed by the actuator 111 and moved toward the second coupling body 115. The movement of the first coupling body 114 causes the first coupling pin 114*p* to be guided by the first pin guiding groove 114*h*, so that the first supporting lobes 109*a* rotate clockwise. As the first supporting lobes 109*a* rotate, the second supporting lobes 109*b* rotate clockwise, so that the second coupling pin 115*p* is guided by the second pin guiding groove 115*h*. This increases the inclination angle of the swash plate 109 and thus increases the stroke of the double-headed pistons 108. Accordingly, the displacement is increased.

PRIOR ART DOCUMENT

Patent Document

Patent Document 1: Japanese Laid-Open Patent Publication No. 5-172052

SUMMARY OF THE INVENTION

Problems that the Invention is to Solve

In the compressor 100 of Patent Document 1, the double-headed pistons 108 apply compression reactive force P10 to the swash plate 109 as illustrated in FIG. 12. The compression reactive force P10 is applied to the swash plate 109 so as to change the inclination angle of the swash plate 109.

When the swash plate 109 receives the compression reactive force P10, each first supporting lobe 109*a* receives a force F10 along the normal line at the contacting part between the first coupling pin 114*p* and the first supporting lobe 109*a*. The force F10 is directed to the first coupling body 114 and intersects with the moving direction of the first coupling body 114 (the axis of the rotary shaft 106). Further, at the contacting part between the first coupling pin 114*p* and the first arm 114*a*, a force F11, which is a reactive force of the force F10 acting on each first supporting lobe 109*a*, acts on the first arm 114*a* from the swash plate 109 via the first coupling pin 114*p*.

Also, when the swash plate 109 receives the compression reactive force P10, each second supporting lobe 109*b* receives a force F12 along the normal line at the contacting part between the second coupling pin 115*p* and the second supporting lobe 109*b*. The force F12 is directed to the second coupling body 115 and is parallel with the force F10. Further, at the contacting part between the second coupling pin 115*p* and the second arm 115*a*, a force F13, which is a reactive force of the force F12 acting on each second supporting lobe 109*b*, acts on the second arm 115*a* from the swash plate 109 via the second coupling pin 115*p*.

Due to the equilibrium of the forces F10, F11 and the equilibrium of the forces F12, F13, the inclination angle of the swash plate 109 is maintained at a desired inclination angle without being changed by the compression reactive force P10.

At this time, the force F11 is resolved into a force F11*y*, which has a component in a direction perpendicular to the moving direction of the first coupling body 114 (the vertical direction), and a force P11*x*, which has a component in the moving direction of the first coupling body 114 (the horizontal direction). The force F11*y*, which has a component in a direction perpendicular to the moving direction of the first coupling body 114, acts on the first arm 114*a* in a direction away from the rotary shaft 106. Therefore, the force F11*y*, which has a component in a direction perpendicular to the moving direction of the first coupling body 114, acts to tilt the first coupling body 114 relative to the moving direction of the first coupling body 114 via the first arm 114*a*. As a result, the sliding resistance between the first coupling body 114 and the rotary shaft 106 is increased when the first coupling body 114 moves. This may hamper smooth change in the inclination angle of the swash plate 109.

Accordingly, it is an objective of the present invention to provide a variable displacement swash plate type compressor that smoothly changes the inclination angle of the swash plate.

Means for Solving the Problems

To achieve the foregoing objective and in accordance with one aspect of the present invention, a variable displacement swash plate type compressor is provided. A cylinder block, which constitutes a housing, has a plurality of cylinder bores. A piston is reciprocally accommodated in each cylinder bore. A crank chamber accommodates a link mechanism and a swash plate. The link mechanism is fixed to a rotary shaft and rotates integrally with the rotary shaft. The swash plate is rotated by a drive force from the rotary shaft via the link mechanism. An inclination angle of the swash plate relative to the rotary shaft is changed. The pistons are engaged with the swash plate. The compressor includes a partition body provided on the rotary shaft, a movable body, a control pressure chamber, a sliding portion, and a guiding surface. The movable body is coupled to the swash plate via a coupling member. The movable body is moved relative to the partition body in an axial direction of the rotary shaft to change the inclination angle of the swash plate. The control pressure chamber is defined by the movable body and the partition body, wherein an internal pressure of the control pressure chamber is changed by introducing control gas thereinto, thereby moving the movable body. The sliding portion, which is provided on the swash plate and slides on the rotary shaft. The guiding surface, which is provided on the rotary shaft and guides the sliding portion. The swash plate is supported by the rotary shaft via the link mechanism, the movable body, and the sliding portion, so that the inclination angle of the swash plate relative to the rotary shaft is determined.

When the pistons apply a compression reactive force to the swash plate, a force along the normal line acts on the swash plate at the contacting part between the coupling member and the swash plate. At the contacting part between the coupling member and the movable body, since the inclination angle of the swash plate is maintained at a desired inclination angle without being changed by the compression reactive force, a force that is a reactive force of the force acting on the swash plate along the normal line acts on the movable body. The force acting on the movable body is resolved into a force that has a component in a direction perpendicular to the moving direction of the movable body (the vertical direction) and a force that has a component in the moving direction of the movable body (the horizontal direction). The force that has a component in a direction perpendicular to the moving direction of the movable body acts on the movable body in a direction away from the rotary shaft. At this time, the sliding portion is guided by the guiding surface and the swash plate is supported by the rotary shaft via the sliding portion. This reduces the force that acts on the swash plate and has a component in a direction perpendicular to the moving direction of the movable body. Accordingly, the force that acts on the movable body from the swash plate via the coupling member and has a component in a direction perpendicular to the moving direction of the movable body is reduced. Thus, when the inclination angle of the swash plate is changed by the link mechanism as the movable body is moved by a change in the internal pressure of the control pressure chamber due to introduction of control gas, the movable body is restrained from being inclined relative to the moving direction of the movable body. This allows the inclination angle of the swash plate to be smoothly changed.

In the above described variable displacement swash plate type compressor, a gradient of the guiding surface relative to a central axis of the rotary shaft preferably changes as the inclination angle of the swash plate changes.

At the contacting part between the sliding portion and the guiding surface, a force along the normal line acts on the guiding surface from the swash plate via the sliding portion. At the contacting part between the guiding surface and the sliding portion, due to the equilibrium of forces, the reactive force of the force in the normal line acting on the guiding surface acts on the swash plate from the rotary shaft via the sliding portion. The force acting on the swash plate is resolved into a force that has a component in a direction perpendicular to the moving direction of the movable body and a force that has a component in the moving direction of the movable body. Thus, since the gradient of the guiding surface changes as the inclination angle of the swash plate changes, the direction of the force acting on the swash plate from the rotary shaft via the sliding portion is changed in accordance with the inclination angle of the swash plate. This adjusts the force having a component in a direction perpendicular to the moving direction of the movable body and the force having a component in the moving direction of the movable body.

When a force having a component in the moving direction of the movable body acts on the swash plate from the rotary shaft via the sliding portion, the force is transmitted to the movable body via the swash plate and the coupling member. That force, which is transmitted from the swash plate to the movable body and has a component in the moving direction of the movable body, may become a force that assists movement of the movable body or a force that hampers such movement. For example, if the force, which is transmitted from the swash plate to the movable body and has a component in the moving direction of the movable body, assists movement of the movable body, it is possible to move the movable body even if the pressure in the control pressure chamber is relatively low. Also, for example, if the force that is transmitted from the swash plate to the movable body and has a component in the moving direction of the movable body hampers movement of the movable body, the movable body cannot be moved unless the pressure in the control pressure chamber is increased. Since the gradient of the guiding surface changes as the inclination angle of the swash plate changes, adjustment of the force that acts on the swash plate from the rotary shaft via the sliding portion and has a component in the moving direction of the movable body allows the pressure in the control pressure chamber to be adjusted.

In the above described variable displacement swash plate type, the guiding surface preferably includes a slope section, in which the sliding portion is guided away from the central axis as the movable body is moved in a direction to reduce the inclination angle of the swash plate.

In this configuration, at the contacting part between the slope section and the sliding portion, the reactive force of the force acting on the slope section from the swash plate via the sliding portion is transmitted to the movable body via the sliding portion, the swash plate, and the coupling member, so that the movement of the swash plate is assisted when the inclination angle of the swash plate is increased. This allows the movable body to be moved even if the pressure in the control pressure chamber is relatively low.

In the above described variable displacement swash plate type compressor, the housing preferably includes a pair of cylinder blocks, and the cylinder blocks preferably have cylinder bores, which constitute pairs of cylinder bores. Also, each pair of the cylinder bores preferably reciprocally accommodates one of the pistons. The pistons are preferably double-headed pistons, and each double-headed piston preferably defines a first compression chamber in one of the corresponding cylinder bores and a second compression chamber in the other one of the corresponding cylinder bores.

In a configuration in which a double-headed piston is reciprocally accommodated in cylinder bores constituting a pair, the compression reactive force acting on the swash plate from the double-headed piston acts to reduce the inclination angle of the swash plate. Further, in the configuration in which a double-headed piston is reciprocally accommodated in cylinder bores constituting a pair, as the inclination angle of the swash plate decreases, the dead volume increases in the first compression chamber as the inclination angle of the swash plate decreases. However, as the inclination angle of the swash plate decreases, the discharge stroke is performed in the second compression chamber without any significant increase in the dead volume. As the inclination angle of the swash plate is reduced from the maximum inclination angle, the dead volume in the first compression chamber is increased. Accordingly, in the suction stroke in the first compression chamber, the time of re-expansion, in which the pressure is lowered to the suction pressure, is extended. This increases the force that acts on the swash plate from the double-headed piston in a direction to reduce the inclination angle of the swash plate.

Then, when the inclination angle of the swash plate is reduced to a predetermined inclination angle and the dead volume of the first compression chamber becomes a predetermined volume, refrigerant gas stops being discharged from the first compression chamber. Thus, in the process in which the inclination angle of the swash plate decreases from the predetermined inclination angle to the minimum inclination angle, the pressure in the first compression chamber does not reach the discharge pressure. Therefore, discharge and suction of refrigerant gas are not performed, and only compression and expansion of refrigerant gas are repeated. As a result, the force of the pressure in the first compression chamber that presses the double-headed pistons is decreased. This decreases the force that acts on the swash plate from the double-headed pistons to reduce the inclination angle.

In the process in which the inclination angle of the swash plate is changed from the minimum inclination angle to the predetermined inclination angle, the force that is generated by re-expansion of refrigerant gas in the first compression chamber and acts on the swash plate from the double-headed pistons in a direction to reduce the inclination angle of the swash plate is relatively small. Therefore, to increase the inclination angle of the swash plate from the minimum inclination angle to the predetermined inclination angle, it is only required to increase the pressure in the control pressure chamber. In the process in which the inclination angle of the swash plate is changed from the predetermined inclination angle to the maximum inclination angle, the force that is generated by re-expansion of refrigerant gas in the first compression chamber and acts on the swash plate from the double-headed pistons in a direction to reduce the inclination angle of the swash plate is maximized when the inclination angle of the swash plate is the predetermined inclination angle.

That is, when the inclination angle of the swash plate is the predetermined inclination angle, the resultant force of the compression reactive force, which acts on the swash plate from the double-headed pistons, and the force that is generated by re-expansion of refrigerant gas in the first compression chamber and acts on the swash plate from the double-headed pistons in a direction to reduce the inclination angle of the swash plate is maximized. Further, as the inclination angle of the swash plate is increased to the maximum inclination angle from the predetermined inclination angle, the dead volume in the first compression chamber decreases. This decreases the force that is generated by re-expansion of refrigerant gas in the first compression chamber and acts on the swash plate from the double-headed pistons in a direction to reduce the inclination angle of the swash plate.

Therefore, the pressure in the control pressure chamber required to maintain the inclination angle of the swash plate is greatest when the inclination angle of the swash plate is the predetermined inclination angle and is decreased as the inclination angle increases from the predetermined inclination angle to the maximum inclination angle. As a result, in the conventional technique, there is a zone in which the pressure in the control pressure chamber required to increase the inclination angle of the swash plate from the predetermined angle to the maximum inclination angle is equal to the pressure in the control pressure chamber required to increase the inclination angle of the swash plate from the minimum inclination angle to the predetermined inclination angle. This makes it hard to accurately control the inclination angle of the swash plate.

However, in the present invention, the gradient of the guiding surface is adjusted such that the force that acts on the swash plate from the double-headed pistons in a direction to reduce the inclination angle of the swash plate can be received. This reduces the force that acts on the swash plate from the double-headed pistons in a direction to reduce the inclination angle of the swash plate. As a result, the inclination angle of the swash plate can be set to increase from the minimum inclination angle to the maximum inclination angle by simply increasing the pressure in the control pressure chamber. As described above, the present invention is suitably applied to the configuration in which a double-headed piston is reciprocally accommodated in cylinder bores constituting a pair.

In the above described variable displacement swash plate type compressor, the coupling member preferably extends through a movable body through hole provided in the movable body and a swash plate through hole provided in the swash plate, and the coupling member is preferably slidably held by the movable body through hole or by the swash plate through hole.

When the inclination angle of the swash plate is changed, this configuration prevents inclination of the swash plate in the axial direction relative to the rotary shaft from being blocked by interference of the coupling member with the movable body or the swash plate.

In the above described variable displacement swash plate type compressor, the swash plate preferably includes a sliding member, which has the sliding portion.

With this configuration, since the sliding portion can be provided separately from the swash plate, the material of the sliding portion is not limited to the material of the swash plate. Thus, by providing a sliding portion made of a material of an excellent wear resistance, the sliding resistance between the sliding portion and the rotary shaft is reduced.

In the above described variable displacement swash plate type compressor, the sliding member is preferably rotationally supported by the swash plate.

With this configuration, the sliding resistance between the sliding member and the rotary shaft is reduced in comparison to a case in which the sliding member is supported by the swash plate in a non-rotational state.

In the above described variable displacement swash plate type compressor, the link mechanism preferably includes a lug arm, which is coupled to the swash plate and is fixed to the rotary shaft to rotate integrally with the rotary shaft. A first coupling position, at which the lug arm and the swash plate are coupled to each other, is preferably located on an opposite side of the rotary shaft to a second coupling position, at which the movable body and the swash plate are coupled to each other. The sliding portion is preferably provided on the swash plate to be arranged between the first coupling position and the rotary shaft.

A variable displacement swash plate type compressor having this configuration is easy to manufacture.

Effects of the Invention

The present invention allows the inclination angle of the swash plate to be is changed smoothly.

MODES FOR CARRYING OUT THE INVENTION

One embodiment of the present invention will now be described with reference to FIGS. 1 to 7. A variable displacement swash plate type compressor (hereinafter, simply referred to as "compressor") is mounted in a vehicle.

Figure 1:
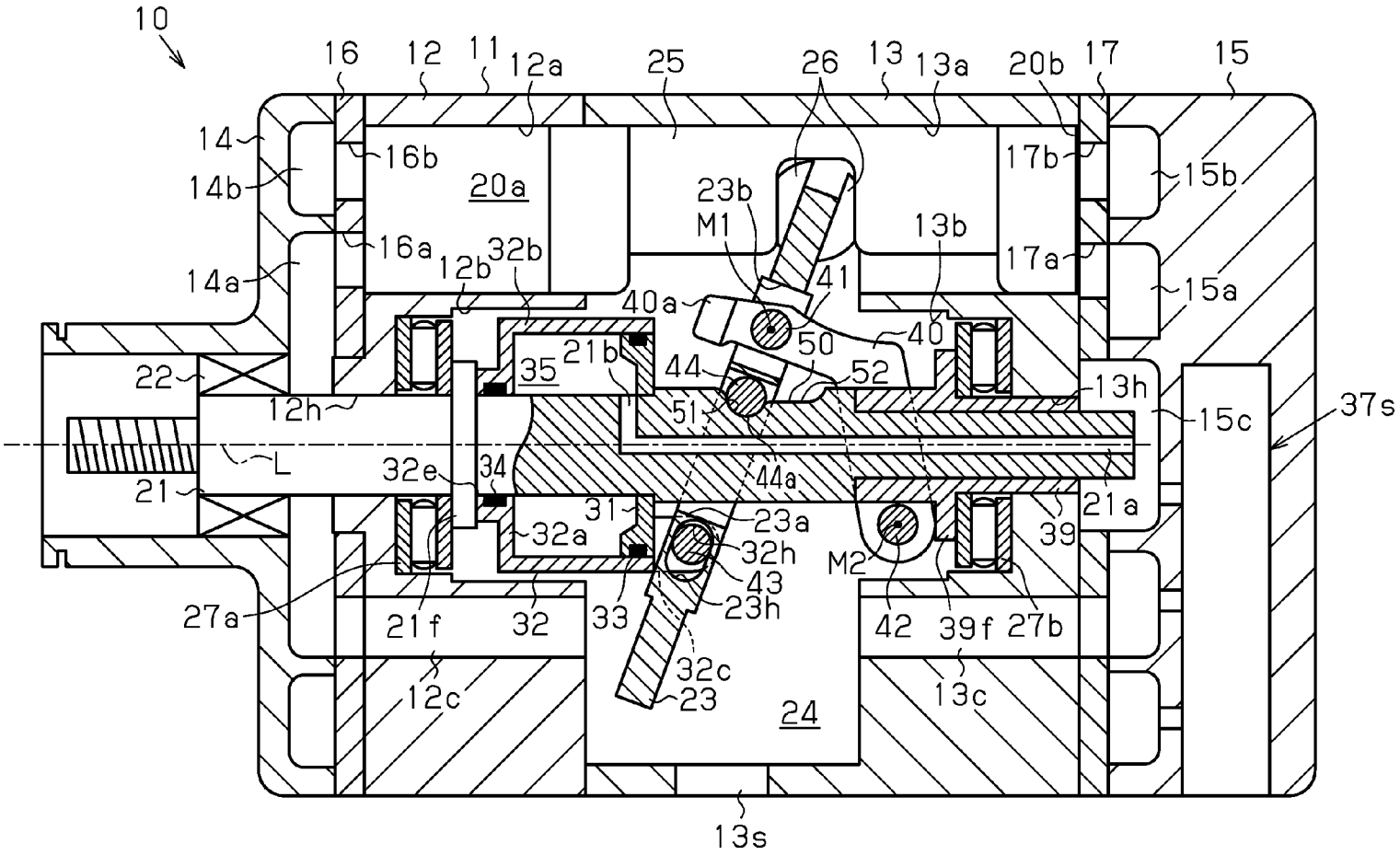
FIG. 1 is a cross-sectional side view illustrating a variable displacement swash plate type compressor according to one embodiment.

As shown in FIG. 1, a compressor 10 includes a housing 11, which has a first cylinder block 12 located on the front side (first side) and a second cylinder block 13 located on the rear side (second side). The first and second cylinder blocks 12, 13 are joined to each other. The housing 11 further includes a front housing member 14 joined to the first cylinder block 12 and a rear housing member 15 joined to the second cylinder block 13. The first cylinder block 12 and the second cylinder block 13 are a pair of cylinder blocks that is a part of the housing 11.

A first valve plate 16 is arranged between the front housing member 14 and the first cylinder block 12. Further, a second valve plate 17 is arranged between the rear housing member 15 and the second cylinder block 13.

A suction chamber 14*a* and a discharge chamber 14*b* are defined between the front housing member 14 and the first valve plate 16. The discharge chamber 14*b* is located radially outward of the suction chamber 14*a*. Likewise, a suction chamber 15*a* and a discharge chamber 15*b* are defined between the rear housing member 15 and the second valve plate 17. Additionally, a pressure adjusting chamber 15*c* is arranged in the rear housing member 15. The pressure adjusting chamber 15*c* is located at the center of the rear housing member 15, and the suction chamber 15*a* is located radially outward of the pressure adjusting chamber 15*c*. The discharge chamber 15*b* is located radially outward of the suction chamber 15*a*. The discharge chambers 14*b*, 15*b* are connected to each other through a discharge passage (not shown). The discharge passage is in turn connected to an external refrigerant circuit (not shown).

The first valve plate 16 has suction ports 16*a* connected to the suction chamber 14*a* and discharge ports 16*b* connected to the discharge chamber 14*b*. The second valve plate 17 has suction ports 17*a* connected to the suction chamber 15*a* and discharge ports 17*b* connected to the discharge chamber 15*b*. Each of the suction ports 16*a*, 17*a* has a suction valve mechanism (not shown), and each of the discharge ports 16*b*, 17*b* has a discharge valve mechanism (not shown).

A rotary shaft 21 is rotationally supported in the housing 11. A part of the rotary shaft 21 on the front side (first side) extends through a shaft hole 12*h*, which is provided in the first cylinder block 12. Specifically, the front part of the rotary shaft 21 is located on the first side in the direction in which the central axis L of the rotary shaft 21 extends (the axial direction of the rotary shaft 21). The front end of the rotary shaft 21 is located in the front housing member 14. A part of the rotary shaft 21 on the rear side (second side) extends through a shaft hole 13*h*, which is provided in the second cylinder block 13. Specifically, the rear part of the rotary shaft 21 is a part of the rotary shaft 21 that is located on the second side in the direction in which the central axis L of the rotary shaft 21 extends. The rear end of the rotary shaft 21 is located in the pressure adjusting chamber 15*c*.

The front part of the rotary shaft 21 is rotationally supported by the first cylinder block 12 via the shaft hole 12*h*. The rear part of the rotary shaft 21 is rotationally supported by the second cylinder block 13 via the shaft hole 13*h*. A sealing device 22 of lip seal type is located between the front housing member 14 and the rotary shaft 21.

In the housing 11, the first cylinder block 12 and the second cylinder block 13 define a crank chamber 24. The crank chamber 24 accommodates a swash plate 23, which rotates when receiving drive force from the rotary shaft 21 and is tiltable along the axis of the rotary shaft 21. The swash plate 23 has a through hole 23*a*, through which the rotary shaft 21 extends. The swash plate 23 is assembled to the rotary shaft 21 by inserting the rotary shaft 21 into the through hole 23*a*.

The first cylinder block 12 has first cylinder bores 12*a* (only one of the first cylinder bores 12*a* is illustrated in FIG. 1), which are cylinder bores on one side. The first cylinder bores 12*a* extend through the first cylinder block 12 along the axis and are arranged about the rotary shaft 21. Each first cylinder bore 12*a* is connected to the suction chamber 14*a* via the corresponding suction port 16*a* and is connected to the discharge chamber 14*b* via the corresponding discharge port 16*b*. The second cylinder block 13 has second cylinder bores 13*a* (only one of the second cylinder bores 13*a* is illustrated in FIG. 1), which are cylinder bores on the other side. The second cylinder bores 13*a* extend through the second cylinder block 13 along the axis and are arranged about the rotary shaft 21. Each second cylinder bore 13*a* is connected to the suction chamber 15*a* via the corresponding suction port 17*a* and is connected to the discharge chamber 15*b* via the corresponding discharge port 17*b*. The first cylinder bores 12*a* and the second cylinder bores 13*a* are arranged to make front-rear pairs. Each pair of the first cylinder bore 12*a* and the second cylinder bore 13*a* accommodates a double-headed piston 25, while permitting the piston 25 to reciprocate in the front-rear direction.

Each double-headed piston 25 is engaged with the periphery of the swash plate 23 with two shoes 26. The shoes 26 convert rotation of the swash plate 23, which rotates with the rotary shaft 21, to linear reciprocation of the double-headed pistons 25. In each first cylinder bore 12*a*, a first compression chamber 20*a* is defined by the double-headed piston 25 and the first valve plate 16. In each second cylinder bore 13*a*, a second compression chamber 20*b* is defined by the double-headed piston 25 and the second valve plate 17.

The first cylinder block 12 has a first large diameter hole 12*b*, which is continuous with the shaft hole 12*h* and has a larger diameter than the shaft hole 12*h*. The first large diameter hole 12*b* communicates with the crank chamber 24. The crank chamber 24 and the suction chamber 14*a* are connected to each other by a suction passage 12*c*, which extends through the first cylinder block 12 and the first valve plate 16.

The second cylinder block 13 has a second large diameter hole 13*b*, which is continuous with the shaft hole 13*h* and has a larger diameter than the shaft hole 13*h*. The second large diameter hole 13*b* communicates with the crank chamber 24. The crank chamber 24 and the suction chamber 15*a* are connected to each other by a suction passage 13*c*, which extends through the second cylinder block 13 and the second valve plate 17.

A suction inlet 13*s* is provided in the peripheral wall of the second cylinder block 13. The suction inlet 13*s* is connected to an external refrigerant circuit. Refrigerant gas is drawn into the crank chamber 24 from the external refrigerant circuit via the suction inlet 13*s* and is then drawn into the suction chambers 14*a*, 15*a* via the suction passages 12*c*, 13*c*. The suction chambers 14*a*, 15*a* and the crank chamber 24 are therefore in a suction pressure zone. The pressure in the suction chambers 14*a*, 15*a* and the pressure in the crank chamber 24 are substantially equal to each other.

The rotary shaft 21 has an annular flange portion 21*f*, which is arranged in the first large diameter hole 12*b*. With respect to the axial direction of the rotary shaft 21, a first thrust bearing 27*a* is arranged between the flange portion 21*f* and the first cylinder block 12. A cylindrical supporting member 39 is press fitted to a rear portion of the rotary shaft 21. The supporting member 39 has an annular flange portion 39*f*, which is arranged in the second large diameter hole 13*b*. With respect to the axial direction of the rotary shaft 21, a second thrust bearing 27*b* is arranged between the flange portion 39*f* and the second cylinder block 13.

An annular partition body 31 is arranged on and fixed to the rotary shaft 21 to be integrally rotational with the rotary shaft 21. The partition body 31 is located rearward of the flange portion 21*f* and forward of the swash plate 23. A cylindrical movable body 32 having a closed end is located between the flange portion 21*f* and the partition body 31. The movable body 32 is movable along the axis of the rotary shaft 21 with respect to the partition body 31.

The movable body 32 includes an annular bottom portion 32*a* and a cylindrical portion 32*b*. The bottom portion 32*a* has a through hole 32*e*, through which the rotary shaft 21 extends. The cylindrical portion 32*b* extends along the axis of the rotary shaft 21 from the outer periphery of the bottom portion 32*a*. The inner circumferential surface of the cylindrical portion 32*b* is slidable along the outer periphery of the partition body 31. This allows the movable body 32 to rotate integrally with the rotary shaft 21 via the partition body 31. The clearance between the inner circumferential surface of the cylindrical portion 32*b* and the outer periphery of the partition body 31 is sealed with a sealing member 33. Likewise, the clearance between the through hole 32*e* and the rotary shaft 21 is sealed with a sealing member 34. The partition body 31 and the movable body 32 define a control pressure chamber 35 in between.

The rotary shaft 21 has a first in-shaft passage 21*a*, which extends along the central axis L of the rotary shaft 21. The rear end of the first in-shaft passage 21*a* opens to the interior of the pressure adjusting chamber 15*c*. The rotary shaft 21 further has a second in-shaft passage 21*b*, which extends in the radial direction of the rotary shaft 21. One end of the second in-shaft passage 21*b* communicates with the distal end of the first in-shaft passage 21*a*. The other end of the second in-shaft passage 21*b* opens to the interior of the control pressure chamber 35. Accordingly, the control pressure chamber 35 and the pressure adjusting chamber 15*c* are connected to each other by the first in-shaft passage 21*a* and the second in-shaft passage 21*b*.

Figure 2:
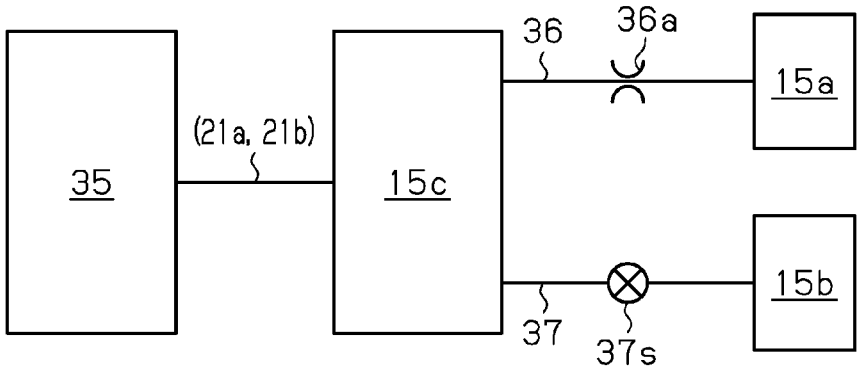
FIG. 2 is a diagram showing the relationship among a control pressure chamber, a pressure adjusting chamber, a suction chamber, and a discharge chamber.

As shown in FIG. 2, the pressure adjusting chamber 15*c* and the suction chamber 15*a* are connected to each other by a bleed passage 36. The bleed passage 36 has an orifice 36*a*, which restricts the flow rate of refrigerant gas flowing in the bleed passage 36. The pressure adjusting chamber 15*c* and the discharge chamber 15*b* are connected to each other by a supply passage 37. An electromagnetic control valve 37*s* is arranged in the supply passage 37. The control valve 37*s* is allowed to adjust the opening degree of the supply passage 37 based on the pressure in the suction chamber 15*a*. The control valve 37*s* adjusts the flow rate of refrigerant gas flowing in the supply passage 37.

Refrigerant gas is introduced to the control pressure chamber 35 from the discharge chamber 15*b* via the supply passage 37, the pressure adjusting chamber 15*c*, the first in-shaft passage 21*a*, and the second in-shaft passage 21*b*. Refrigerant gas in the control pressure chamber 35 is discharged to the suction chamber 15*a* via the second in-shaft passage 21*b*, the first in-shaft passage 21*a*, the pressure adjusting chamber 15*c*, and the bleed passage 36. The introduction and discharge of refrigerant gas adjusts the pressure in the control pressure chamber 35. Thus, the refrigerant gas introduced into the control pressure chamber 35 serves as control gas for regulating the pressure in the control pressure chamber 35. The pressure difference between the control pressure chamber 35 and the crank chamber 24 causes the movable body 32 to move along the axis of the rotary shaft 21 with respect to the partition body 31.

As shown in FIG. 1, a lug arm 40 is provided between the swash plate 23 and the flange portion 39*f* in the crank chamber 24. The lug arm 40 substantially has an L shape extending from a first end to a second end. The lug arm 40 has a weight portion 40*a* arranged at the first end. The weight portion 40*a* extends to a position in front of the swash plate 23 through a groove 23*b* of the swash plate 23.

The first end of the lug arm 40 is coupled to the upper side (upper side as viewed in FIG. 1) of the swash plate 23 by a first pin 41, which extends across the groove 23*b*. In this configuration, the first end of the lug arm 40 is supported by the swash plate 23 such that the lug arm 40 is allowed to swing about a first swing axis M1, which is the axis of the first pin 41. The second end of the lug arm 40 is connected to the supporting member 39 by a second pin 42. In this configuration, the second end of the lug arm 40 is supported by the supporting member 39 such that the second end of the lug arm 40 is allowed to swing about a second swing axis M2, which is the axis of the second pin 42.

Two coupling portions 32*c* are provided at the distal end of the cylindrical portion 32*b* of the movable body 32. The coupling portions 32*c* protrude toward the swash plate 23. Each coupling portion 32*c* has a movable body through hole 32*h* configured to receive a third pin 43, which serves as a coupling member. The swash plate 23 has a swash plate through hole 23*h* configured to receive the third pin 43 on the lower side (lower side as viewed in FIG. 1). The swash plate through hole 23*h* has an elongated shape that extends in a direction in which the swash plate 23 extends. The third pin 43 couples the coupling portion 32*c* to the lower part of the swash plate 23. The third pin 43 is press fitted in the movable body through holes 32*h* to be secured to the coupling portion 32*c* and are slidably held by the swash plate through hole 23*h*.

Thus, a first coupling position, at which the lug arm 40 and the swash plate 23 are coupled to each other by the first pin 41, is located on the opposite side of the rotary shaft 21 to a second coupling position, at which the movable body 32 and the swash plate 23 are coupled to each other by the third pin 43.

The swash plate 23 further includes a fourth pin 44, which extends across the through hole 23*a* and serves as a sliding member. The fourth pin 44 is located in the swash plate 23 at a position between the rotary shaft 21 and the first coupling position, at which the lug arm 40 and the swash plate 23 are coupled to each other by the first pin 41. The fourth pin 44 is rotationally supported by the swash plate 23. Further, the rotary shaft 21 has a guiding surface 50 in a part of the outer circumferential surface (the part that faces the fourth pin 44). Following changes in the inclination angle of the swash plate 23, a sliding portion 44*a* of the fourth pin 44 (the outer circumferential surface of the fourth pin 44) slides along and is guided by the guiding surface 50. The guiding surface 50 is a groove on the rotary shaft 21. The guiding surface 50 has a slope section 51, which is sloped relative to the central axis L of the rotary shaft 21, and a flat section 52, which is continuous with the slope section 51 and extends along the axis of the rotary shaft 21. The flat section 52 is located rearward of the slope section 51 (closer to the supporting member 39).

Figure 3:
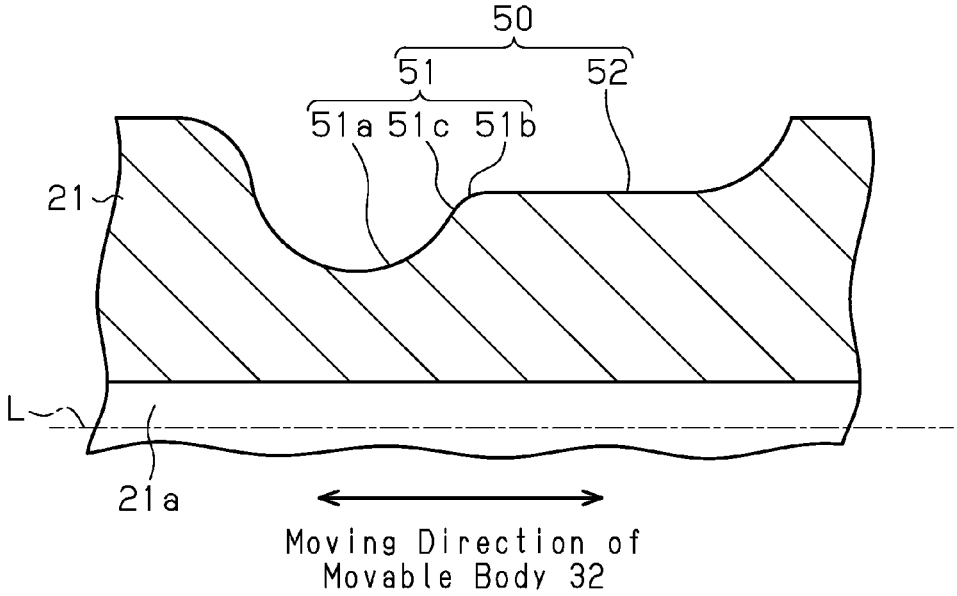
FIG. 3 is an enlarged cross-sectional side view showing the guiding surface.

As shown in FIG. 3, the slope section 51 includes a gradual increase section 51*a*, in which, from a position closer to the movable body 32 toward the flat section 52, the gradient relative to the central axis L gradually increases as the distance from the central axis L of the rotary shaft 21 increases. The slope section 51 also includes a gradual decrease section 51*b*, in which, from a position closer to the movable body 32 toward the flat section 52, the gradient relative to the central axis L gradually decreases as the distance from the central axis L of the rotary shaft 21 increases. The gradual increase section 51*a* has a maximum gradient section 51*c*, which is continuous with the gradual decrease section 51*b* and has the maximum gradient relative to the central axis L of the rotary shaft 21. Thus, the gradual increase section 51*a*, the maximum gradient section 51*c*, and the gradual decrease section 51*b* are continuously provided from a position closer to the movable body 32 toward the flat section 52. Therefore, as the inclination angle of the swash plate 23 changes, the gradient of the slope section 51 relative to the central axis L of the rotary shaft 21 changes.

In the compressor 10 having the above described configuration, reduction in the opening degree of the control valve 37*s* reduces the amount of refrigerant gas that is delivered to the control pressure chamber 35 from the discharge chamber 15*b* via the supply passage 37, the pressure adjusting chamber 15*c*, the first in-shaft passage 21*a*, and the second in-shaft passage 21*b*. Since the refrigerant gas in the control pressure chamber 35 is discharged to the suction chamber 15*a* via the second in-shaft passage 21*b*, the first in-shaft passage 21*a*, the pressure adjusting chamber 15*c*, and the bleed passage 36, the pressure in the control pressure chamber 35 and the pressure in the suction chamber 15*a* are substantially equalized. Thus, when the pressure difference between the control pressure chamber 35 and the crank chamber 24 is decreased, the movable body 32 is moved such that the bottom portion 32*a* of the movable body 32 approaches the partition body 31.

At the contacting part between the third pin 43 and the swash plate 23, the third pin 43 slides along the inner surface of the swash plate through hole 23*h* while applying a force along the normal line to the swash plate 23, and the swash plate 23 swings about the first swing axis M1. As the swash plate 23 swings about the first swing axis M1, the ends of the lug arm 40 swing about the first swing axis M1 and the second swing axis M2, respectively, so that the lug arm 40 approaches the flange portion 39*f* of the supporting member 39. This reduces the inclination angle of the swash plate 23 and thus reduces the stroke of the double-headed pistons 25. Accordingly, the displacement is decreased.

Figure 4:
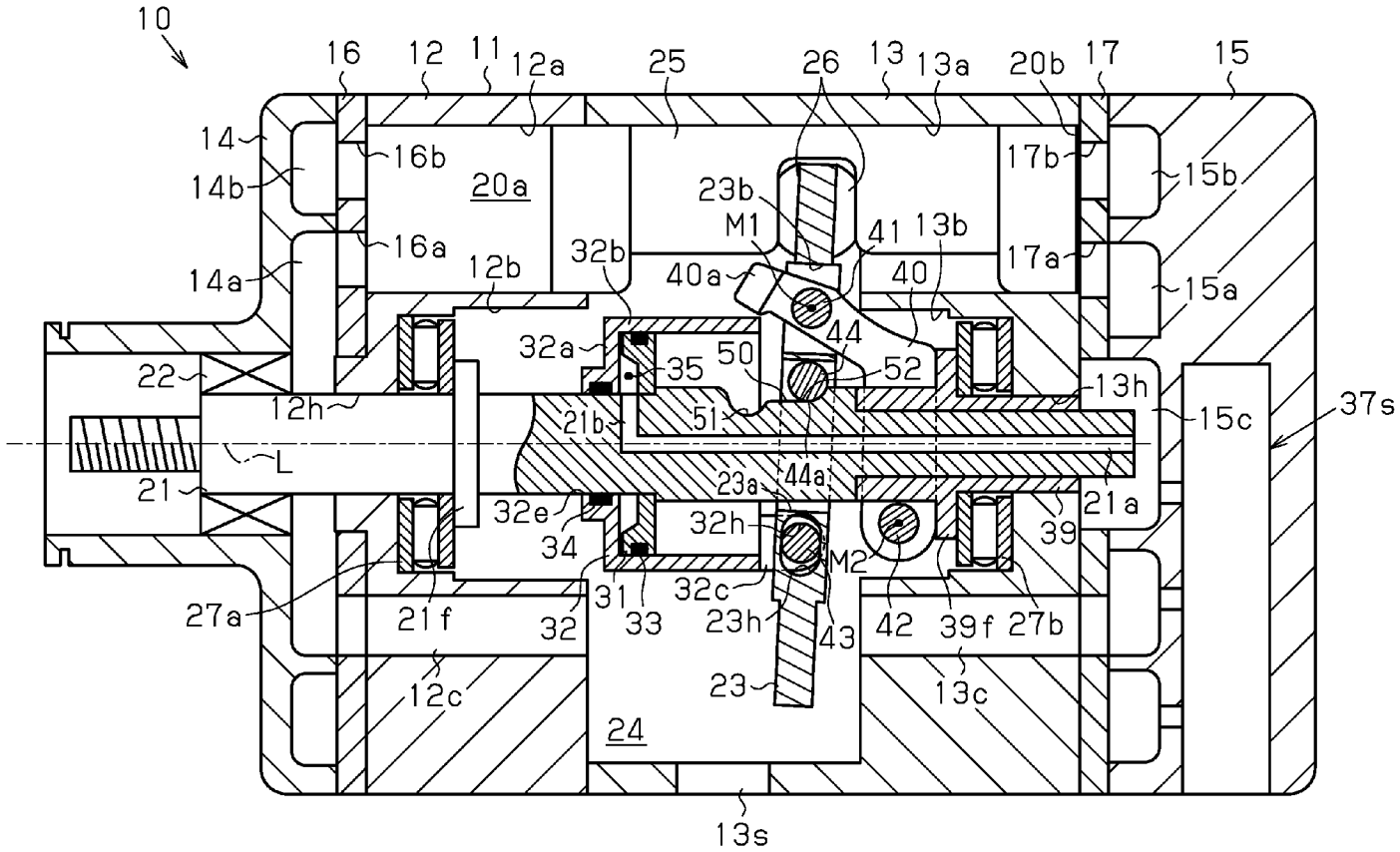
FIG. 4 is a cross-sectional side view illustrating the variable displacement swash plate type compressor when the swash plate is at the minimum inclination angle.

As shown in FIG. 4, the lug arm 40 is configured to contact the flange portion 39*f* of the supporting member 39 when the swash plate 23 reaches the minimum inclination angle θmin. The contact between the lug arm 40 and the flange portion 39*f* maintains the minimum inclination angle θmin of the swash plate 23.

Increase in the opening degree of the control valve 37*s* increases the amount of refrigerant gas that is delivered to the control pressure chamber 35 from the discharge chamber 15*b* via the supply passage 37, the pressure adjusting chamber 15*c*, the first in-shaft passage 21*a*, and the second in-shaft passage 21*b*. This substantially equalizes the pressure in the control pressure chamber 35 to the pressure in the discharge chamber 15*b*. Thus, when the pressure difference between the control pressure chamber 35 and the crank chamber 24 is increased, the movable body 32 is moved such that the bottom portion 32*a* of the movable body 32 is separated away from the partition body 31.

At the contacting part between the third pin 43 and the swash plate 23, the third pin 43 slides along the inner surface of the swash plate through hole 23*h* while applying a force along the normal line to the swash plate 23, and the swash plate 23 swings about the first swing axis M1 in a direction opposite to the swing direction to reduce the inclination angle of the swash plate 23. As the swash plate 23 swings about the first swing axis M1 in a direction opposite to the inclination angle decreasing direction, the ends of the lug arm 40 swing about the first swing axis M1 and the second swing axis M2, respectively, in a direction opposite to the swing direction to reduce the inclination angle of the swash plate 23, so that the lug arm 40 is separated away from the flange portion 39*f* of the supporting member 39. This increases the inclination angle of the swash plate 23 and thus increases the stroke of the double-headed pistons 25. Accordingly, the displacement is increased.

As shown in FIG. 1, the movable body 32 is configured to contact the flange portion 21*f* when the swash plate 23 reaches the maximum inclination angle θmax. The contact between the movable body 32 and the flange portion 21*f* maintains the maximum inclination angle θmax of the swash plate 23. Therefore, in the present embodiment, the lug arm 40, the first pin 41, and the second pin 42 constitute a link mechanism that allows the inclination angle of the swash plate 23 to be changed by movement of the movable body 32. The swash plate 23 is supported by the rotary shaft 21 via the link mechanism, the movable body 32, and the fourth pin 44, so that the inclination angle of the swash plate 23 relative to the rotary shaft 21 is determined.

Operation of the present embodiment will now be described.

Figure 5:
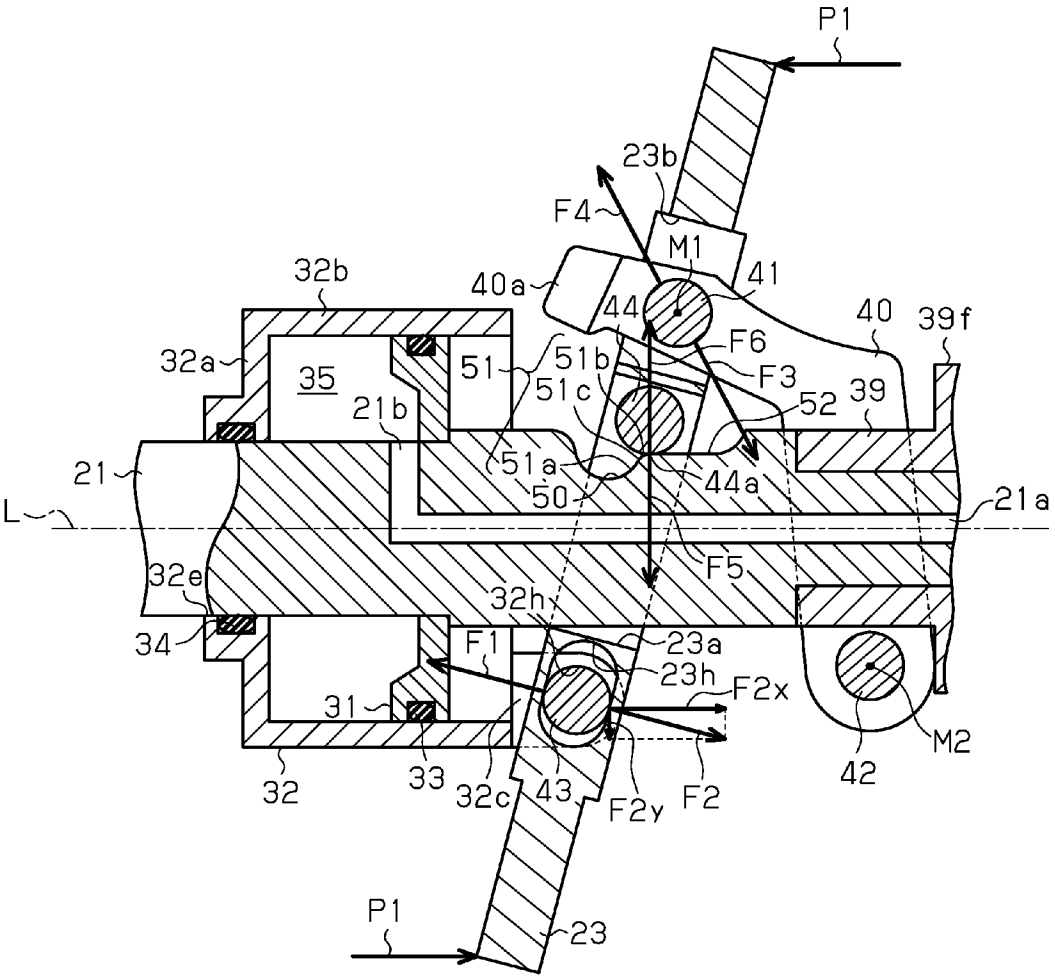
FIG. 5 is a partial cross-sectional side view illustrating the variable displacement swash plate type compressor when the swash plate is at a desired inclination angle.

When the compressor 10 is operating with the swash plate 23 at a desired inclination angle as shown in FIG. 5, the double-headed pistons 25 apply a compression reactive force P1 to the swash plate 23. The desired inclination angle in FIG. 5 refers to an angle that is greater than the minimum inclination angle θmin and smaller than the maximum inclination angle θmax. The compression reactive force P1 acts to reduce the inclination angle of the swash plate 23.

When the swash plate 23 receives the compression reactive force P1, the swash plate 23 receives a force F1 along the normal line at the contacting part between the third pin 43 and the swash plate 23. The force F1 is directed to the movable body 32 and intersects with the moving direction of the movable body 32 (the axis of the rotary shaft 21). Further, at the contacting part between the third pin 43 and the coupling portion 32*c*, a force F2, which is a reactive force of the force F1 acting on the swash plate 23, acts on the coupling portion 32*c* from the swash plate 23 via the third pin 43.

At this time, the force F2 is resolved into a force F2*y*, which has a component in a direction perpendicular to the moving direction of the movable body 32 (the vertical direction), and a force F2*x*, which has a component in the moving direction of the movable body 32 (the horizontal direction). The force F2*y*, which has a component in a direction perpendicular to the moving direction of the movable body 32, acts on the coupling portion 32*c* in a direction away from the rotary shaft 21. Therefore, the force F2*y*, which has a component in a direction perpendicular to the moving direction of the movable body 32, acts to tilt the movable body 32 relative to the moving direction of the movable body 32 via the coupling portion 32*c*.

When the swash plate 23 receives the compression reactive force P1, a force F3 extending toward the second swing axis M2 acts on the contacting part between the first pin 41 and the swash plate 23. Further, at the contacting part between the first pin 41 and the lug arm 40, a force F4, which is a reactive force of the force F3 acting on the swash plate 23, acts on the lug arm 40 from the swash plate 23 via the first pin 41.

In the present embodiment, the sliding portion 44*a* of the fourth pin 44 is guided by the flat section 52 of the guiding surface 50 of the rotary shaft 21, so that the swash plate 23 is supported by the rotary shaft 21 via the sliding portion 44*a* of the fourth pin 44. Thus, at the contacting part between the sliding portion 44*a* of the fourth pin 44 and the flat section 52 of the guiding surface 50, the equilibrium of forces causes a force F6 to act on the swash plate 23 from the rotary shaft 21 via the fourth pin 44. The force F6 refers to a reactive force of the force F5, which acts on the rotary shaft 21 from the swash plate 23 via the fourth pin 44 and has a component in a direction perpendicular to the moving direction of the movable body 32.

Due to the equilibrium of the forces F1, F2, the equilibrium of the forces F3, F4, and the equilibrium of the forces F5, F6, the inclination angle of the swash plate 23 is maintained at the desired angle without being changed by the compression reactive force P1. Thus, compared to a case in which the inclination angle of the swash plate 23 is maintained without providing the fourth pin 44, the swash plate 23 receives less amount of force that acts on the swash plate 23 and has a component in a direction perpendicular to the moving direction of the movable body 32. This reduces the force F2*y*, which acts on the coupling portion 32*c* from the swash plate 23 via the third pin 43 and has a component in a direction perpendicular to the moving direction of the movable body 32. Therefore, when the inclination angle of the swash plate 23 is changed, the movable body 32 is restrained from being inclined with respect to the moving direction of the movable body. This allows the inclination angle of the swash plate 23 to be changed smoothly.

In a configuration in which each pair of a first cylinder bore 12*a* and a second cylinder bore 13*a* reciprocally accommodates a double-headed piston 25, the dead volume of the first compression chamber 20*a* is increased as the inclination angle of the swash plate 23 decreases. The dead volume refers to the clearance between the first valve plate 16 and the double-headed piston 25 at the top dead center. In contrast, in the second compression chamber 20*b*, the discharge stroke is performed without any significant increase in the dead volume. As the inclination angle of the swash plate 23 is reduced from the maximum inclination angle θmax, the dead volume in the first compression chamber 20*a* is increased. Accordingly, in the suction stroke in the first compression chamber 20*a*, the time of re-expansion, in which the pressure is lowered to the suction pressure, is extended. This increases the force that acts on the swash plate 23 from the double-headed pistons 25 and in a direction to reduce the inclination angle of the swash plate 23.

Then, when the dead volume of the first compression chamber 20*a* becomes a predetermined volume as the inclination angle of the swash plate 23 is reduced to a predetermined inclination angle θx, refrigerant gas stops being discharged from the first compression chamber 20*a*. Thus, in the process in which the inclination angle of the swash plate 23 decreases from the predetermined inclination angle θx to the minimum inclination angle θmin, the pressure in the first compression chamber 20*a* does not reach the discharge pressure. Therefore, discharge and suction of refrigerant gas stop being performed, and only compression and expansion of refrigerant gas are repeated. As a result, the force that is generated by the pressure in the first compression chamber 20*a* to push the double-headed piston 25 is decreased. This decreases the force that acts on the swash plate 23 from the double-headed piston 25 in a direction to reduce the inclination angle.

Figure 6:
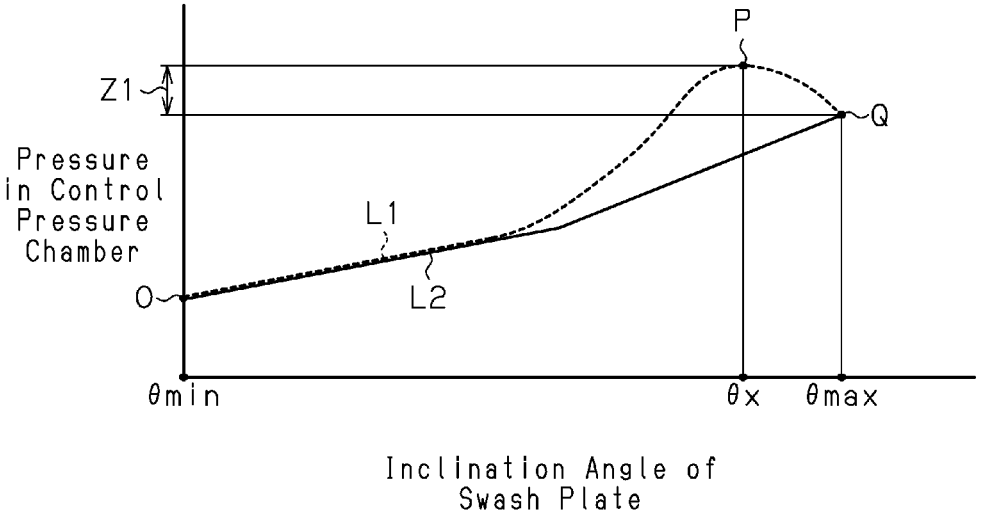
FIG. 6 is a graph showing the relationship between the pressure in the control pressure chamber and the inclination angle of the swash plate.

In FIG. 6, broken line L1 indicates the relationship between the pressure in the control pressure chamber 35 and the inclination angle of the swash plate 23 in a case in which the fourth pin 44 and the guiding surface 50 are not provided (a conventional configuration). In the process in which the inclination angle of the swash plate 23 is changed from the minimum inclination angle θmin to the predetermined inclination angle θx, a force is relatively small that is generated by re-expansion of refrigerant gas in the first compression chamber 20*a* and acts on the swash plate 23 from the double-headed pistons 25 in a direction to reduce the inclination angle of the swash plate 23. Therefore, as shown in FIG. 6, to increase the inclination angle of the swash plate 23 from the minimum inclination angle θmin to the predetermined inclination angle θx, it is merely necessary to increase the pressure in the control pressure chamber 35 (the section from point O to point P on broken line L1).

In the process in which the inclination angle of the swash plate 23 is changed from the predetermined inclination angle θx to the maximum inclination angle θmax, the force that is generated by re-expansion of refrigerant gas in the first compression chamber 20*a* and acts on the swash plate 23 from the double-headed pistons 25 in a direction to reduce the inclination angle of the swash plate 23 is greatest when the inclination angle of the swash plate 23 is the predetermined inclination angle θx.

That is, when the inclination angle of the swash plate 23 is the predetermined inclination angle θx, the resultant is greatest, which is the combination of the compression reactive force P1, which acts on the swash plate 23 from the double-headed pistons 25, and the force that is generated by re-expansion of refrigerant gas in the first compression chamber 20*a* and acts on the swash plate 23 from the double-headed pistons 25 in a direction to reduce the inclination angle of the swash plate 23.

Further, as the inclination angle of the swash plate 23 is increased to the maximum inclination angle θmax from the predetermined inclination angle θx, the dead volume in the first compression chamber 20*a* decreases. Thus, the force is decreased that is generated by re-expansion of refrigerant gas in the first compression chamber 20*a* and acts on the swash plate 23 from the double-headed pistons 25 in a direction to reduce the inclination angle of the swash plate 23.

Therefore, the pressure in the control pressure chamber 35 required to maintain the inclination angle of the swash plate 23 is greatest when the inclination angle of the swash plate 23 is the predetermined angle θx and is decreased as the inclination angle increases from the predetermined inclination angle θx to the maximum inclination angle θmax (the section from point P to point Q on broken line L1). As a result, the conventional technique has a zone Z1, in which the pressure in the control pressure chamber 35 required to increase the inclination angle of the swash plate 23 from the predetermined angle θx to the maximum inclination angle θmax becomes equal to the pressure in the control pressure chamber 35 required to increase the inclination angle of the swash plate 23 from the minimum inclination angle θmin to the predetermined inclination angle θx. This makes it hard to accurately control the inclination angle of the swash plate 23.

Figure 7:
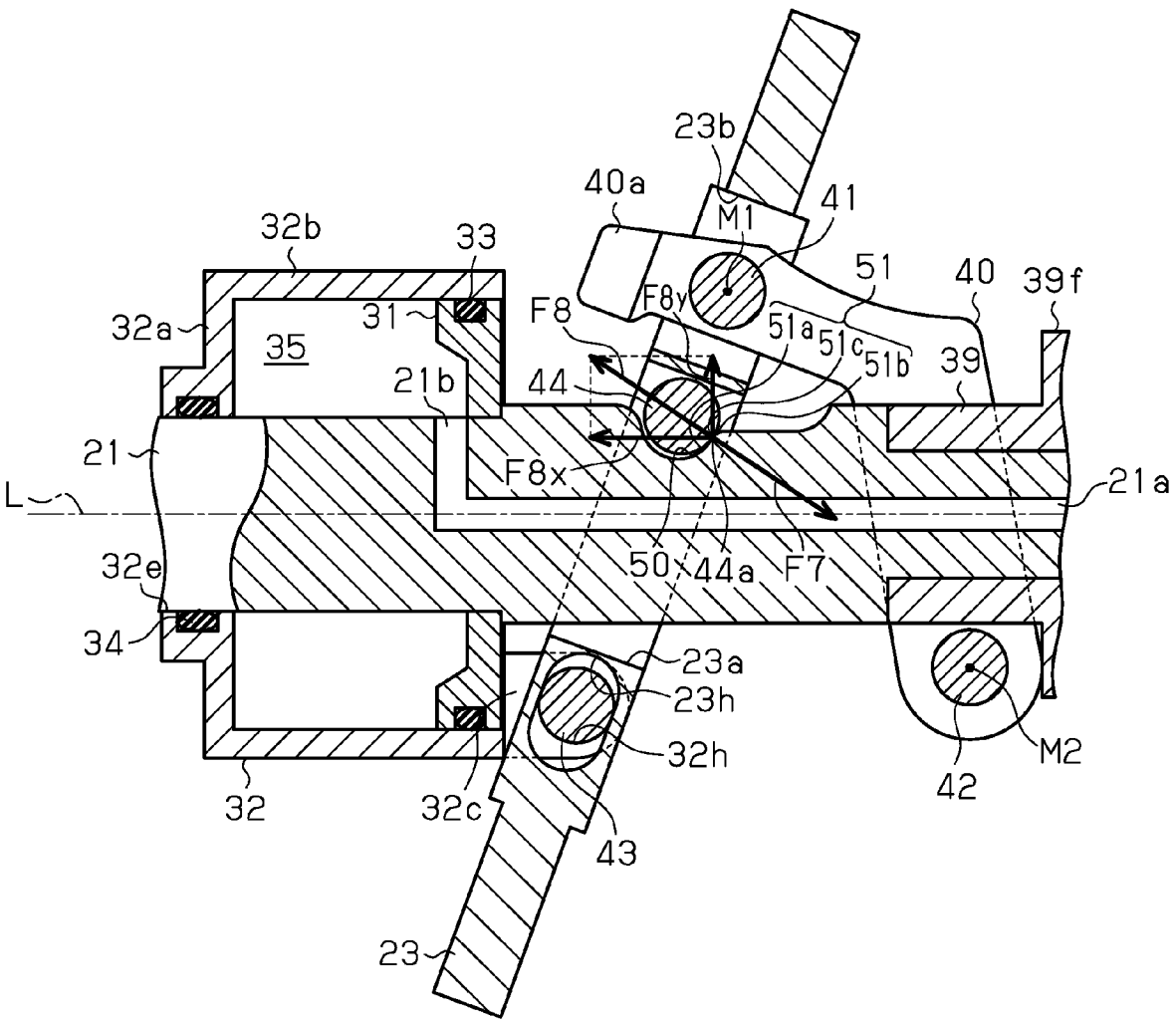
FIG. 7 is a partial cross-sectional side view of the variable displacement swash plate type compressor, illustrating a state in which the inclination angle of the swash plate has been increased to a predetermined inclination angle from the minimum inclination angle, and the dead volume of the first compression chamber has become a predetermined volume.

FIG. 7 illustrates a state according to the present embodiment, in which, after the inclination angle of the swash plate 23 has changed to the predetermined inclination angle θx from the minimum inclination angle θmin, the dead volume of the first compression chamber 20*a* has become a predetermined volume. In the present embodiment, the slope section 51 includes the gradual increase section 51*a*, in which the gradient relative to the central axis L of the rotary shaft 21 gradually increases as the sliding portion 44*a* of the fourth pin 44 moves in a direction in which the movable body 32 is moved to decrease the inclination angle of the swash plate 23 from the maximum inclination angle θmax. The shape of the slope section 51 is set such that, when the inclination angle of the swash plate 23 is the predetermined inclination angle θx, the sliding portion 44*a* of the fourth pin 44 contacts the maximum gradient section 51*c*.

In the above described configuration, the gradient of the slope section 51 is adjusted such that the force that acts on the swash plate 23 from the double-headed pistons 25 in a direction to reduce the inclination angle of the swash plate 23 is received at the contacting part between the maximum gradient section 51*c* of the gradual increase section 51*a* and the sliding portion 44*a* of the fourth pin 44. This reduces the force that acts on the swash plate 23 from the double-headed pistons 25 in a direction to reduce the inclination angle of the swash plate 23. Therefore, as indicated by solid line L2 in FIG. 6, the inclination angle of the swash plate 23 can be set to increase from the minimum inclination angle θmin to the maximum inclination angle θmax by simply increasing the pressure in the control pressure chamber 35.

Further, as shown in FIG. 7, at the contacting part between the sliding portion 44*a* of the fourth pin 44 and the maximum gradient section 51*c*, a force F7 along the normal line acts on the maximum gradient section 51*c* from the swash plate 23 via the sliding portion 44*a* of the fourth pin 44. Also, at the contacting part between the sliding portion 44*a* of the fourth pin 44 and the maximum gradient section 51*c*, due to the equilibrium of the forces, a force F8, which is a reactive force of the force F7 in the normal line acting on the rotary shaft 21, acts on the swash plate 23 from the rotary shaft 21 via the fourth pin 44.

The force F8, which acts on the swash plate 23, is resolved into a force F8*y*, which has a component in a direction perpendicular to the moving direction of the movable body 32, and a force F8*x*, which has a component in the moving direction of the movable body 32. The force F8*x*, which has a component in the moving direction of the movable body 32, acts on the swash plate 23 from the rotary shaft 21 via the fourth pin 44. The force F8*x*, which acts on the swash plate 23 from the rotary shaft 21 via the fourth pin 44 and has a component in the moving direction of the movable body 32, is transmitted to the movable body 32 via the swash plate 23, the third pin 43, and the coupling portion 32*c*. The force F8*x*, which is transmitted to the movable body 32 from the swash plate 23 and has a component in the moving direction of the movable body 32, assists movement of the movable body 32 when the inclination angle of the swash plate 23 is increased. This allows the movable body 32 to be moved even if the pressure in the control pressure chamber 35 is relatively low.

Also, when the gradient of the slope section 51 changes as the inclination angle of the swash plate 23 changes, the direction of the force F8 acting on the swash plate 23 from the rotary shaft 21 via the fourth pin 44 is changed in accordance with the inclination angle of the swash plate 23. This adjusts the force F8*y*, which has a component in a direction perpendicular to the moving direction of the movable body 32, and the force F8*x*, which has a component in the moving direction of the movable body 32.

Thus, when the sliding portion 44*a* of the fourth pin 44 is contacting the maximum gradient section 51*c*, the force F8*x*, which acts on the swash plate 23, is greater than that in a case in which, for example, the sliding portion 44*a* of the fourth pin 44 is contacting the gradual decrease section 51*b* or a part of the gradual increase section 51*a* other than the maximum gradient section 51*c*. Therefore, when the inclination angle of the swash plate 23, the degree of assistance given to the movable body 32 by the force F8*x* acting on the movable body 32 gradually increases as the inclination angle of the swash plate 23 is increased from the minimum inclination angle θmin to the predetermined inclination angle θx and is maximized when the inclination angle of the swash plate 23 is the predetermined inclination angle θx.

Also, when the inclination angle of the swash plate 23, the degree of assistance given to the movable body 32 by the force F8*x* acting on the movable body 32 gradually decreases as the inclination angle of the swash plate 23 is increased from the predetermined inclination angle θx to the maximum inclination angle θmax. As a result, as shown in FIG. 6, the difference in the pressure in the control pressure chamber 35 between the present embodiment and the conventional configuration is greater when the inclination angle of the swash plate 23 is the predetermined inclination angle θx than when the inclination angle of the swash plate 23 is increased from the minimum inclination angle θmin to the predetermined inclination angle θx and when inclination angle is increased from the predetermined inclination angle θx to the maximum inclination angle θmax. Thus, it is possible to increase the inclination angle of the swash plate 23 by monotonically increasing the pressure in the control pressure chamber 35, which further facilitates adjustment of the pressure in the control pressure chamber 35 when the inclination angle of the swash plate 23 is changed.

The above described embodiment provides the following advantages.

(1) The swash plate 23 has the fourth pin 44, which slides along the rotary shaft 21. Further, the rotary shaft 21 has the guiding surface 50, which guides the fourth pin 44. When the swash plate 23 receives the compression reactive force P1 from the double-headed pistons 25, the swash plate 23 receives the force F1 along the normal line at the contacting part between the third pin 43 and the swash plate 23. Since the inclination angle of the swash plate 23 is maintained at a desired inclination angle without being changed by the compression reactive force P1, the force F2, which is a reactive force of the force F1 acting on the swash plate 23 along the normal line, acts on the coupling portion 32*c* of the movable body 32 at the contacting part between the third pin 43 and the coupling portion 32*c* of the movable body 32. The force F2, which acts on the coupling portion 32*c* of the movable body 32, is resolved into a force F2*y*, which has a component in a direction perpendicular to the moving direction of the movable body 32 (the vertical direction), and a force F2*x*, which has a component in the moving direction of the movable body 32 (the horizontal direction). The force F2*y*, which has a component in a direction perpendicular to the moving direction of the movable body 32, acts on the coupling portion 32*c* of the movable body 32 in a direction away from the rotary shaft 21. At this time, the fourth pin 44 is guided by the guiding surface 50 and the swash plate 23 is supported by the rotary shaft 21 via the fourth pin 44. This reduces the force F2*y*, which acts on the swash plate 23 and has a component in a direction perpendicular to the moving direction of the movable body 32. Thus, the force F2*y* is reduced, which acts on the coupling portion 32*c* of the movable body 32 from the swash plate 23 via the third pin 43 and has a component in a direction perpendicular to the moving direction of the movable body 32. Therefore, when the inclination angle of the swash plate 23 is changed, the movable body 32 is restrained from being inclined with respect to the moving direction of the movable body. This allows the inclination angle of the swash plate 23 to be changed smoothly.

(2) As the inclination angle of the swash plate 23 changes, the gradient of the slope section 51 relative to the central axis L of the rotary shaft 21 changes. Accordingly, at the contacting part between the fourth pin 44 and the slope section 51, a force F7 along the normal line acts on the slope section 51 from the swash plate 23 via the fourth pin 44. Also, at the contacting part between the slope section 51 and the sliding portion 44*a* of the fourth pin 44, due to the equilibrium of the forces, a force F8, which is a reactive force of the force F7 in the normal line acting on the rotary shaft 21, acts on the swash plate 23 from the rotary shaft 21 via the fourth pin 44. The force F8, which acts on the swash plate 23, is resolved into a force F8*y*, which has a component in a direction perpendicular to the moving direction of the movable body 32, and a force F8*x*, which has a component in the moving direction of the movable body 32. Also, when the gradient of the slope section 51 changes as the inclination angle of the swash plate 23 changes, the direction of the force F8 acting on the swash plate 23 from the rotary shaft 21 via the fourth pin 44 is changed in accordance with the inclination angle of the swash plate 23. This adjusts the force F8*y*, which has a component in a direction perpendicular to the moving direction of the movable body 32, and the force F8*x*, which has a component in the moving direction of the movable body 32.

Further, when the force F8*x*, which has a component in the moving direction of the movable body 32, acts on the swash plate 23 from the rotary shaft 21 via the fourth pin 44, the force F8*x* is transmitted to the movable body 32 via the swash plate 23, the third pin 43, and the coupling portion 32*c* of the movable body 32. The force F8*x*, which is transmitted to the movable body 32 from the swash plate 23 and has a component in the moving direction of the movable body 32, can be used as a force for assisting movement of the movable body 32. If the movement of the movable body 32 is assisted by the force F8*x*, which is transmitted from the swash plate 23 to the movable body 32 and has a component in the moving direction of the movable body 32, the movable body 32 is allowed to be moved even if the pressure in the control pressure chamber 35 is relatively low.

The force F8*x*, which acts on the swash plate 23 from the rotary shaft 21 via the fourth pin 44 and has a component in the moving direction of the movable body 32, is adjusted by changing the gradient of the slope section 51 as the inclination angle of the swash plate 23 is changed. The pressure in the control pressure chamber 35 is adjusted, accordingly.

(3) The guiding surface 50 has the slope section 51, in which, as the movable body 32 is moved in a direction to decrease the inclination angle of the swash plate 23, the fourth pin 44 is guided to be move away from the central axis L of the rotary shaft 21. In this configuration, at the contacting part between the slope section 51 and the sliding portion 44*a* of the fourth pin 44, the force F8*x*, which acts on the swash plate 23 from the rotary shaft 21 via the fourth pin 44 and has a component in the moving direction of the movable body 32, is transmitted to the movable body 32 via the swash plate 23, the third pin 43, and the coupling portion 32*c* of the movable body 32 to assist movement of the movable body 32 when the inclination angle of the swash plate 23 is increased. This allows the movable body 32 to be moved even if the pressure in the control pressure chamber 35 is relatively low.

(4) In the present embodiment, the gradient of the guiding surface 50 is adjusted such that the guiding surface 50 receives the force that acts on the swash plate 23 from the double-headed pistons 25 in a direction to reduce the inclination angle of the swash plate 23. This reduces the force that acts on the swash plate 23 from the double-headed pistons 25 in a direction to reduce the inclination angle of the swash plate 23. As a result, the inclination angle of the swash plate 23 is set to increase from the minimum inclination angle θmin to the maximum inclination angle θmax by simply increasing the pressure in the control pressure chamber 35.

(5) The third pin 43 is slidably supported by the swash plate through hole 23*h*. This configuration prevents inclination of the swash plate 23 in the axial direction relative to the rotary shaft 21 from being blocked by interference between the third pin 43 and the swash plate 23 when the inclination angle of the swash plate 23 is changed.

(6) The swash plate 23 has the fourth pin 44, which has the sliding portion 44*a*. With this configuration, since the sliding portion 44*a* can be provided separately from the swash plate 23, the material of the sliding portion 44*a* is not limited to the material of the swash plate 23. Thus, by providing a sliding portion 44*a* made of a material having an excellent wear resistance, the sliding resistance between the sliding portion 44*a* and the rotary shaft 21 is reduced.

(7) The fourth pin 44 is rotationally supported by the swash plate 23. With this configuration, the sliding resistance between the fourth pin 44 and the rotary shaft 21 is reduced in comparison to a case in which the fourth pin 44 is supported by the swash plate 23 in a non-rotational state.

(8) The first coupling position, at which the lug arm 40 and the swash plate 23 are coupled to each other, is located on the opposite side of the rotary shaft 21 to the second coupling position, at which the movable body 32 and the swash plate 23 are coupled to each other, and the fourth pin 44 is located in the swash plate 23 at a position between the first coupling position and the rotary shaft 21. The compressor 10 having this configuration is easy to manufacture.

(9) The slope section 51 includes the gradual increase section 51*a*, in which the gradient relative to the central axis L of the rotary shaft 21 gradually increases as the fourth pin 44 moves in a direction to decrease the inclination angle of the movable body 32. The gradual increase section 51*a* has a maximum gradient section 51*c*, which is continuous with the gradual decrease section 51*b* and has the maximum gradient relative to the central axis L of the rotary shaft 21. The sliding portion 44*a* of the fourth pin 44 is contacting the maximum gradient section 51*c*, the force F8*x*, which acts on the swash plate 23, is greater than that in a case in which, for example, the sliding portion 44*a* of the fourth pin 44 is contacting the gradual decrease section 51*b* or a part of the gradual increase section 51*a* other than the maximum gradient section 51*c*. Therefore, when the inclination angle of the swash plate 23, the degree of assistance given to the movable body 32 by the force F8*x* acting on the movable body 32 gradually increases as the inclination angle of the swash plate 23 is increased from the minimum inclination angle θmin to the predetermined inclination angle θx and is maximized when the inclination angle of the swash plate 23 is the predetermined inclination angle θx. Also, when the inclination angle of the swash plate 23, the degree of assistance given to the movable body 32 by the force F8*x* acting on the movable body 32 gradually decreases as the inclination angle of the swash plate 23 is increased from the predetermined inclination angle θx to the maximum inclination angle θmax. As a result, it is possible to increase the inclination angle of the swash plate 23 by monotonically increasing the pressure in the control pressure chamber 35, which further facilitates adjustment of the pressure in the control pressure chamber 35 when the inclination angle of the swash plate 23 is changed.

(10) Conventionally, in a configuration in which each pair of a first cylinder bore 12*a* and a second cylinder bore 13*a* accommodates a double-headed piston 25, a certain amount of increase in the dead volume, if not significantly great, occurs in the second compression chamber 20*b*. However, in the present embodiment, the shape of the slope section 51 allows the position of the swash plate 23 to be changed in the axial direction. Thus, when the inclination angle of the swash plate 23 is changed, it is possible to maintain the dead volume of the second compression chamber 20*b* at a constant volume depending on the shape of the slope section 51. That is, the dead volume is allowed to be adjusted by properly setting the shape of the slope section 51.

The above described embodiment may be modified as follows.

Figure 8:
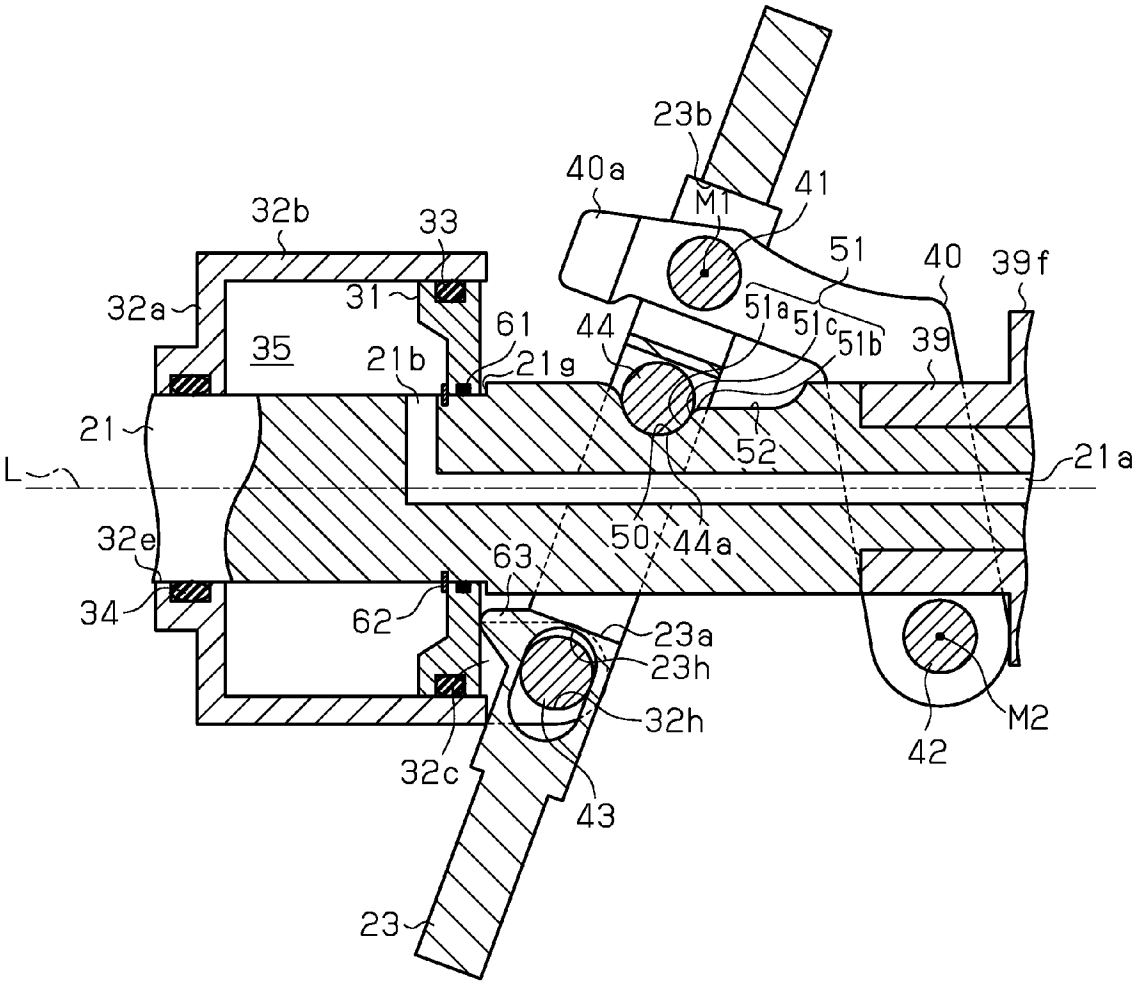
FIG. 8 is a partial cross-sectional side view illustrating a variable displacement swash plate type compressor according to another embodiment, illustrating a state in which the swash plate is at the maximum inclination angle.

As shown in FIG. 8, the partition body 31 does not necessarily need to be fixed to the rotary shaft 21. That is, the partition body 31 may be movable relative to the rotary shaft 21 in the axial direction of the rotary shaft 21. A sealing member 61 is provided between the inner circumferential surface of the partition body 31 and the rotary shaft 21 to seal the clearance between the inner circumferential surface of the partition body 31 and the rotary shaft 21. The rotary shaft 21 has an annular step portion 21*g* on the outer circumferential surface. The step portion 21*g* is located between the swash plate 23 and the opening of the second in-shaft passage 21*b* in the control pressure chamber 35. When the partition body 31 contacts the step 21*g*, the movement of the partition body 31 toward the swash plate 23 in the axial direction of the rotary shaft 21 is restricted. A snap ring 62 is fitted on the outer circumferential surface of the rotary shaft 21 at a position between the step portion 21*g* and the opening of the second in-shaft passage 21*b* in the control pressure chamber 35. When the partition body 31 contacts the snap ring 62, the movement of the partition body 31 away from the swash plate 23 in the axial direction of the rotary shaft 21 is restricted. This prevents the partition body 31 from moving beyond the opening of the second in-shaft passage 21*b* in the control pressure chamber 35. The partition body 31 is rotated by the rotational force of the rotary shaft 21, which is transmitted via the sealing member 61.

The swash plate 23 has a protrusion 63 on a surface that faces the partition body 31. The protrusion 63 contacts the partition body 31 when the swash plate 23 reaches the maximum inclination angle θmax. The contact between the protrusion 63 and the partition body 31 maintains the maximum inclination angle θmax of the swash plate 23. Also, when the protrusion 63 contacts the partition body 31, the partition body 31 is moved toward the snap ring 62. The movement of the partition body 31 toward the snap ring 62 reduces the impact when the protrusion 63 contacts the partition body 31. After moving toward the snap ring 62, the partition body 31 is moved until contacting the step portion 21*g* by the pressure in the control pressure chamber 35, while maintaining the contact with the protrusion 63. Accordingly, the inclination angle of the swash plate 23 is increased to the maximum inclination angle θmax.

When the movable body 32 is moved such that the bottom portion 32*a* of the movable body 32 moves away from the partition body 31, the partition body 31 moves toward the snap ring 62, while following the movable body 32, as the movable body 32 moves. In this configuration, compared to case in which the partition body 31 is fixed to the rotary shaft 21, the frictional resistance between the inner circumferential surface of the cylindrical portion 32*b* of the movable body 32 and the outer periphery of the partition body 31 is reduced. This allows the inclination angle of the swash plate 23 to be changed smoothly.

Figure 9:
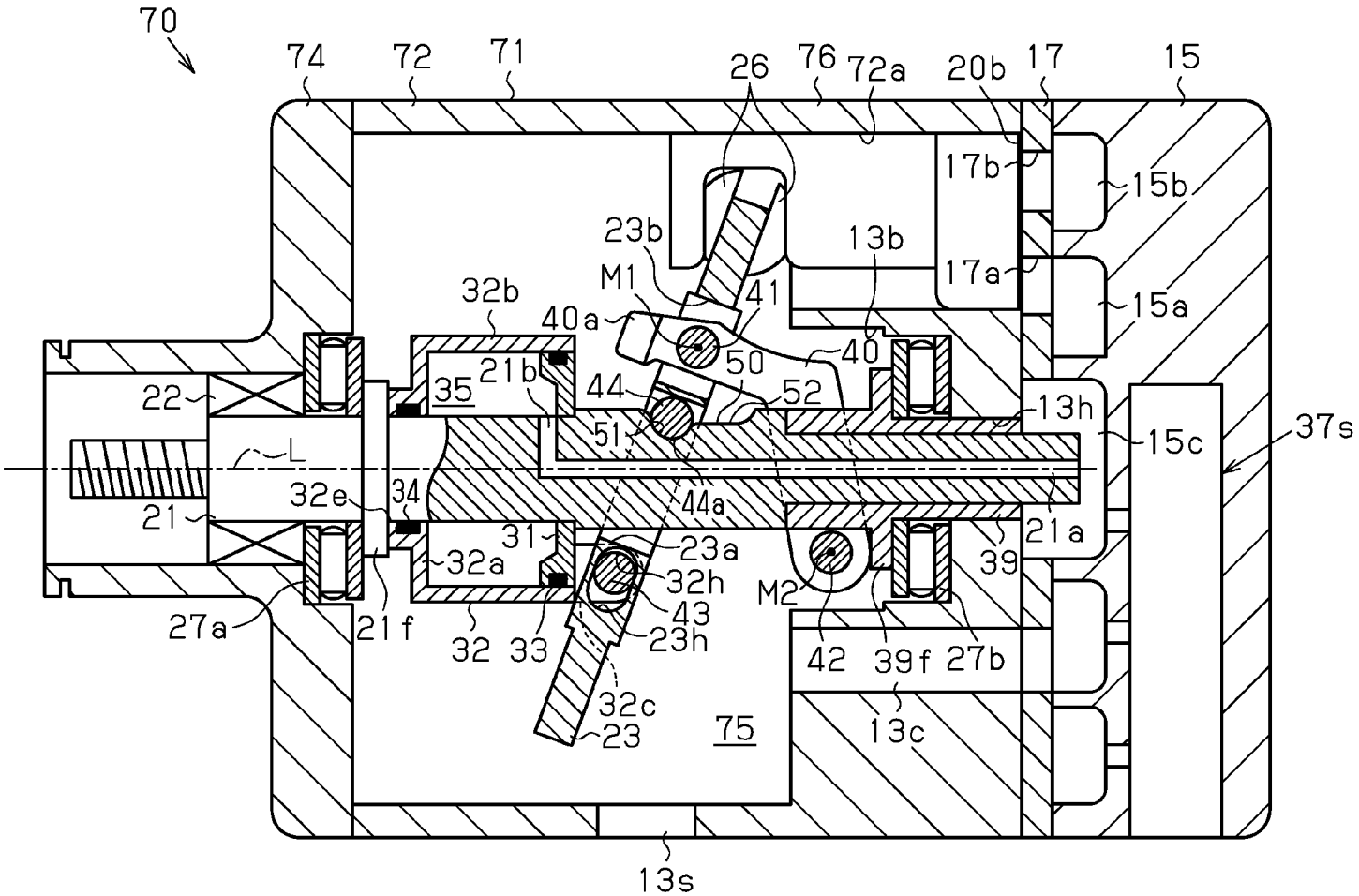
FIG. 9 is a cross-sectional side view illustrating a variable displacement swash plate type compressor according to another embodiment.
Figure 10:
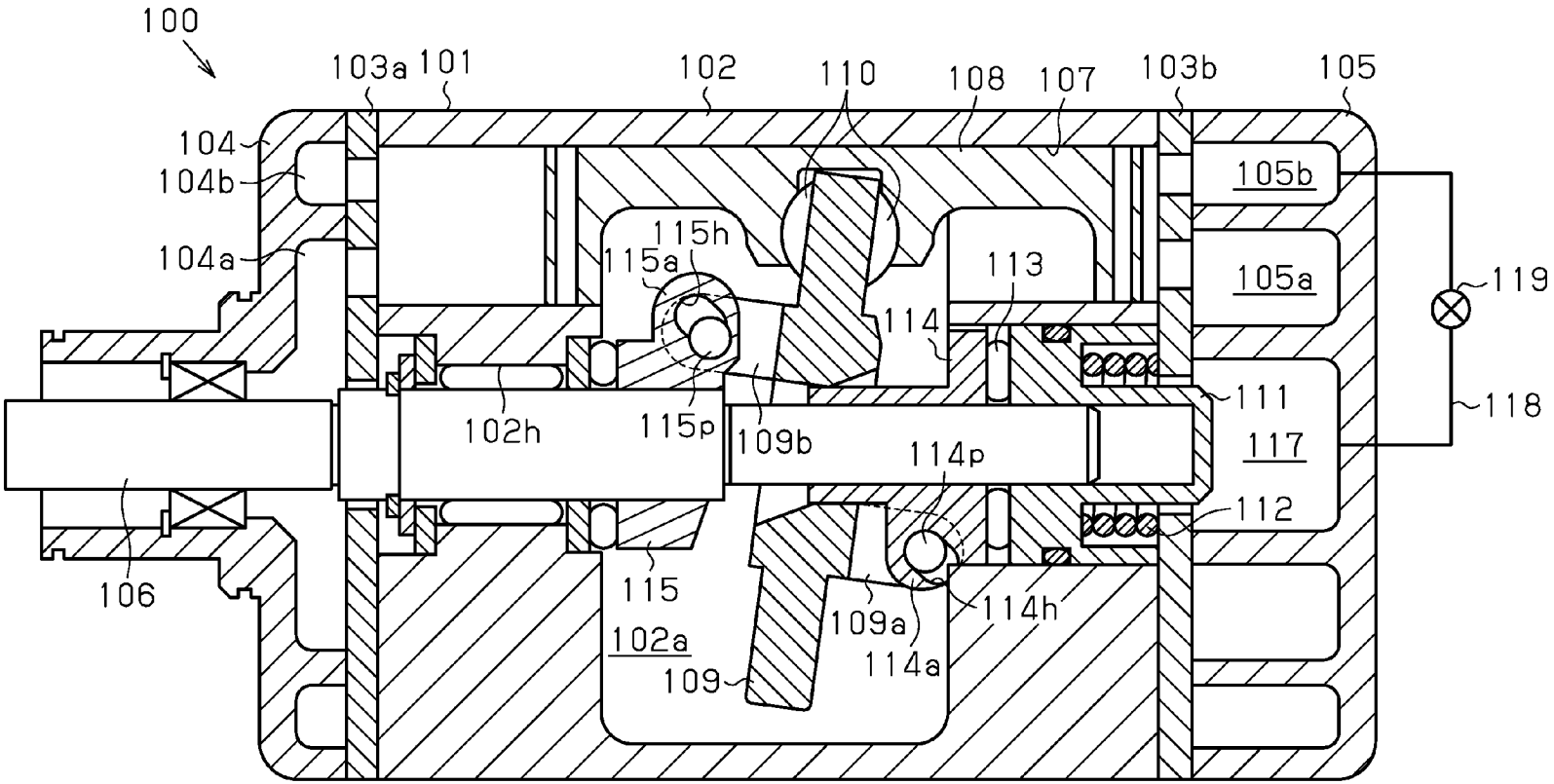
Fig.10(Prior Art)
FIG. 10 is a cross-sectional side view illustrating a conventional variable displacement swash plate type compressor.
Figure 11:
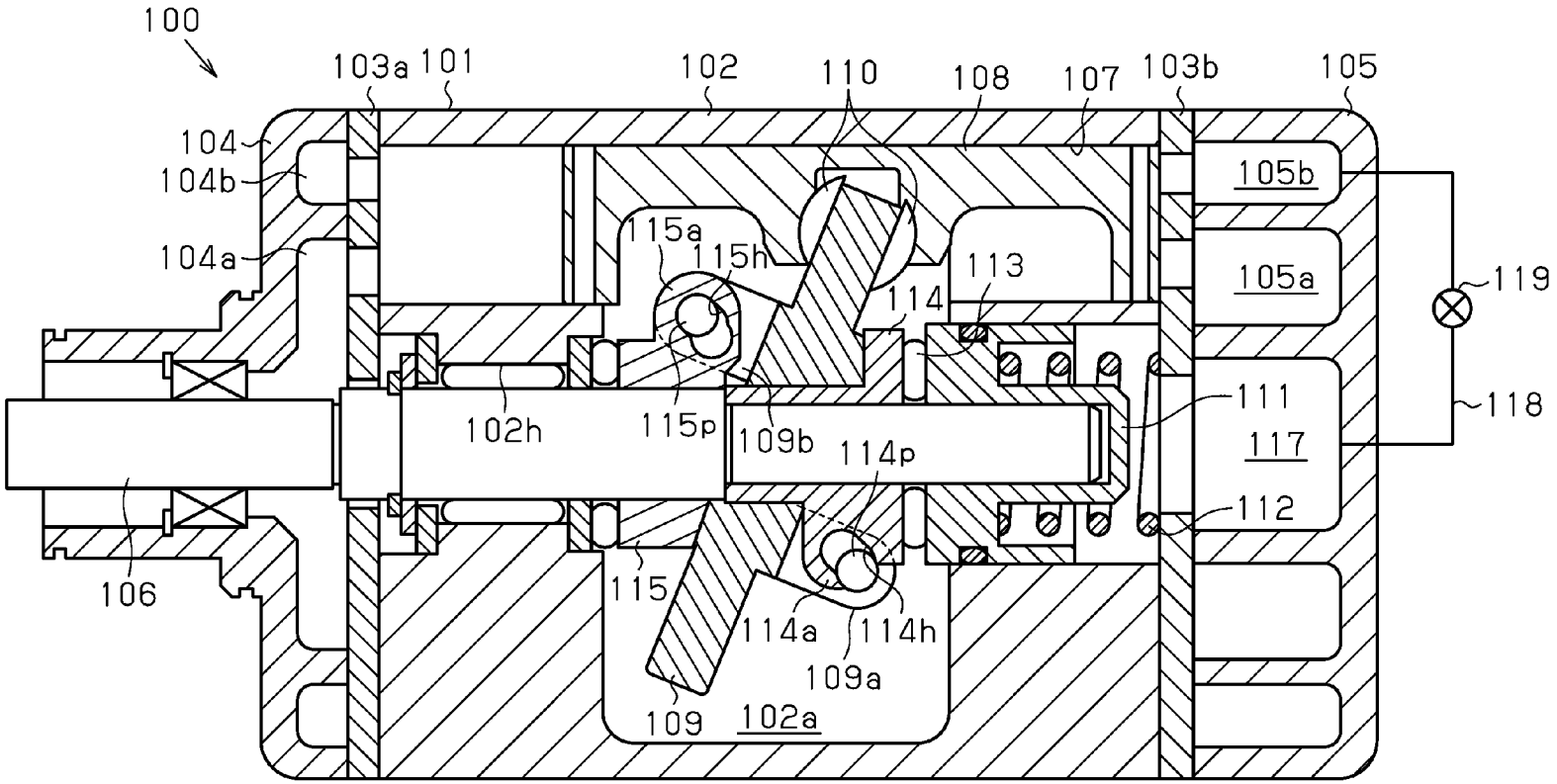
Fig.11(Prior Art)
FIG. 11 is a cross-sectional side view illustrating the conventional variable displacement swash plate type compressor when the swash plate is at the maximum inclination angle.
Figure 12:
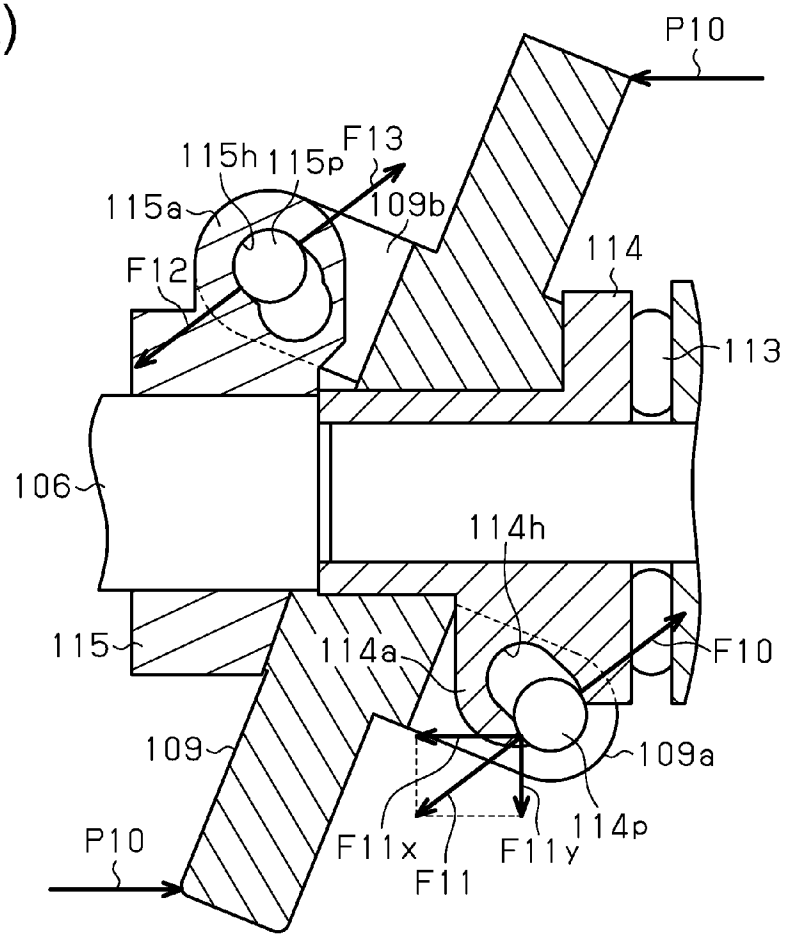
Fig.12(Prior Art)
FIG. 12 is a partial cross-sectional side view illustrating the conventional variable displacement swash plate type compressor.

FIG. 9 illustrates a compressor 70 having a housing 71, which includes a cylinder block 72, a front housing member 74, and a rear housing member 15. The front housing member 74 is secured to the front end of the cylinder block 72. The rear housing member 15 is secured to the rear end of the cylinder block 72. The housing 71 has therein a crank chamber 75, which is defined by the cylinder block 72 and the front housing member 74. The cylinder block 72 has cylinder bores 72*a* (only one of the cylinder bores 72*a* is illustrated in FIG. 9), which extend along the axis of the cylinder block 72 and are arranged about the rotary shaft 21. Each cylinder bore 72*a* is connected to the suction chamber 15*a* via the corresponding suction port 17*a* and is connected to the discharge chamber 15*b* via the corresponding discharge port 17*b*. Each cylinder bore 72*a* accommodates a single-headed piston 76 to reciprocate in the front-rear direction.

Since the first cylinder block 12 and the second cylinder block 13 are omitted, the compressor 70 has a simple configuration and is reduced in size along the axis of the rotary shaft 21.

In the above illustrated embodiments, the force that is transmitted to the movable body 32 from the swash plate 23 and has a component in the moving direction of the movable body 32 may be used as a force for hampering movement of the movable body 32. If the force having a component in the moving direction of the movable body 32, which is transmitted to the movable body 32 from the swash plate 23, hampers movement of the movable body 32, the movable body 32 cannot be moved unless the pressure in the control pressure chamber 35 is increased to a relatively high pressure. This allows the force that is transmitted to the movable body 32 from the swash plate 23 and has a component in the moving direction of the movable body 32 to be used to adjust the pressure in the control pressure chamber 35.

In the above illustrated embodiments, the movable body through holes 32*h* may each have an elongated shape that extends in a direction in which the swash plate 23 extends. The third pin 43 may be press fitted in the swash plate through hole 23*h* to be secured to the swash plate 23 and slidable in the movable body through holes 32*h* in the extending direction of the swash plate 23.

In the illustrated embodiments, a sliding portion, which slides on the rotary shaft 21, may be integrated with the swash plate 23.

In the illustrated embodiments, the fourth pin 44 may be provided to be non-rotational relative to the swash plate 23.

In the illustrated embodiments, the first coupling position, at which the lug arm 40 and the swash plate 23 are coupled to each other, the second coupling position, at which the movable body 32 and the swash plate 23 are coupled to each other, and the position on the swash plate 23 on which the sliding portion 44*a* is provided are not particularly limited.

In the illustrated embodiments, the guiding surface 50 may extend over the entire outer circumferential surface of the rotary shaft 21. Compared to the configuration in which the guiding surface 50 is provided on a part of the outer circumferential surface of the rotary shaft 21, machining of the rotary shaft 21 for providing the guiding surface 50 is facilitated.

In the illustrated embodiments, the slope section 51 has the gradual increase section 51*a*, the maximum gradient section 51*c*, and the gradual decrease section 51*b*. However, the slope section 51 may have a constant gradient relative to the central axis L.

In the illustrated embodiments, the slope section 51 and the flat section 52 may be properly combined to provide a guiding surface 50.

In the illustrated embodiments, the slope section 51 may be omitted from the guiding surface 50, and the guiding surface 50 may have only the flat section 52, which extends along the axis of the rotary shaft 21.

In the illustrated embodiments, the flat section 52 may be omitted from the guiding surface 50, and the guiding surface 50 may have only the slope section 51. The direction of inclination of the slope section 51 is not particularly limited.

In the illustrated embodiments, the groove on the rotary shaft 21 may be omitted and a part of the outer circumferential surface of the rotary shaft 21 may function as a guiding surface.

DESCRIPTION OF THE REFERENCE NUMERALS

10, 70 . . . Compressor (Variable Displacement Swash Plate Type Compressor),
11, 71 . . . Housing,
12 . . . First Cylinder Block constituting Cylinder Block,
12*a* . . . First Cylinder Bores as Cylinder Bore on One Side,
13 . . . Second Cylinder Block constituting Cylinder Block,
13*a* . . . Second Cylinder Bores as Cylinder Bore on the Other Side,
20*a* . . . First Compression Chamber,
20*b* . . . Second Compression Chamber,
21 . . . Rotary Shaft,
23 . . . Swash Plate,
23*h* . . . Swash Plate Insertion Hole,
24, 75 . . . Crank Chamber,
25 . . . Double-Headed Piston,
31 . . . Partition Body,
32 . . . Movable Body,
32*h* . . . Movable Body Insertion Hole,
35 . . . Control Pressure Chamber,
40 . . . Lug Arm constituting Link Mechanism,
41 . . . First Pin constituting Link Mechanism,
42 . . . Second Pin constituting Link Mechanism,
43 . . . Third Pin as Coupling Member,
44 . . . Fourth Pin as Sliding Member,
44*a* . . . Sliding Portion,
50 . . . Guiding Surface,
51 . . . Slope section,
72 . . . Cylinder Block,
72*a* . . . Cylinder Bore,
76 . . . Single-Headed Piston

The invention claimed is:

1. A variable displacement swash plate type compressor, wherein:

a cylinder block, which constitutes a housing, has a plurality of cylinder bores;

a piston is reciprocally accommodated in each cylinder bore;

a crank chamber accommodates a link mechanism and a swash plate;

the link mechanism is fixed to a rotary shaft and rotates integrally with the rotary shaft;

the swash plate is rotated by a drive force from the rotary shaft via the link mechanism, an inclination angle of the swash plate relative to the rotary shaft is changed; and the pistons are engaged with the swash plate;

the compressor comprising:

a partition body provided on the rotary shaft;

a movable body coupled to the swash plate via a coupling member, wherein the movable body is moved relative to the partition body in an axial direction of the rotary shaft to change the inclination angle of the swash plate;

a control pressure chamber defined by the movable body and the partition body, wherein an internal pressure of the control pressure chamber is changed by introducing control gas thereinto, thereby moving the movable body;

a sliding portion, which is provided on the swash plate and slides on the rotary shaft; and a guiding surface, which is provided on the rotary shaft and guides the sliding portion, wherein the swash plate is supported by the rotary shaft via the link mechanism, the movable body, and the sliding portion, so that the inclination angle of the swash plate relative to the rotary shaft is determined.

2. The variable displacement swash plate type compressor according to claim 1, wherein a gradient of the guiding surface relative to a central axis of the rotary shaft changes as the inclination angle of the swash plate changes.

3. The variable displacement swash plate type compressor according to claim 2, wherein the guiding surface includes a slope section, in which the sliding portion is guided away from the central axis as the movable body is moved in a direction to reduce the inclination angle of the swash plate.

4. The variable displacement swash plate type compressor according to claim 2, wherein:

the housing includes a pair of cylinder blocks;

the cylinder blocks have cylinder bores, which constitute pairs of cylinder bores;

each pair of the cylinder bores reciprocally accommodates one of the pistons, the pistons are double-headed pistons, each double-headed piston defines a first compression chamber in one of the corresponding cylinder bores and a second compression chamber in the other one of the corresponding cylinder bores.

5. The variable displacement swash plate type compressor according to claim 1, wherein:

the coupling member extends through a movable body through hole provided in the movable body and a swash plate through hole provided in the swash plate; and the coupling member is slidably held by the movable body through hole or by the swash plate through hole.

6. The variable displacement swash plate type compressor according to claim 1, wherein the swash plate includes a sliding member, which has the sliding portion.

7. The variable displacement swash plate type compressor according to claim 6, wherein the sliding member is rotationally supported by the swash plate.

8. The variable displacement swash plate type compressor according to claim 1, wherein:

the link mechanism includes a lug arm, which is coupled to the swash plate and is fixed to the rotary shaft to rotate integrally with the rotary shaft;

a first coupling position, at which the lug arm and the swash plate are coupled to each other, is located on an opposite side of the rotary shaft to a second coupling position, at which the movable body and the swash plate are coupled to each other; and the sliding portion is provided on the swash plate to be arranged between the first coupling position and the rotary shaft.

* * * * *